US007590380B2

(12) United States Patent
Mima

(10) Patent No.: US 7,590,380 B2
(45) Date of Patent: Sep. 15, 2009

(54) BOOKBINDING APPARATUS AND BOOKBINDING METHOD

(75) Inventor: Tsuyoshi Mima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 478 days.

(21) Appl. No.: 11/620,963

(22) Filed: Jan. 8, 2007

(65) Prior Publication Data

US 2007/0177890 A1 Aug. 2, 2007

(30) Foreign Application Priority Data

Jan. 30, 2006 (JP) ..... 2006-020970

(51) Int. Cl.
*B41J 29/38* (2006.01)
*B65H 37/04* (2006.01)
*G03G 21/00* (2006.01)

(52) U.S. Cl. ..... 399/408; 399/405; 399/19; 399/82; 400/76

(58) Field of Classification Search ..... 399/408
See application file for complete search history.

(56) References Cited

U.S. PATENT DOCUMENTS 4,864,350 A * 9/1989 Ishiguro et al. ..... 399/14
2004/0098665 A1 5/2004 Kasahara et al.

FOREIGN PATENT DOCUMENTS

JP 63116170 A * 5/1988
JP 2004042539 A * 2/2004
JP 2004-155152 A 6/2004
JP 2004254047 A * 9/2004

* cited by examiner

*Primary Examiner*—Daniel J Colilla
(74) *Attorney, Agent, or Firm*—Canon U.S.A. Inc., I.P. Division

(57) ABSTRACT

When printing is interrupted, the selection between the use of a sheet bundle stacked on an accumulating tray and no use thereof is appropriately made. A bookbinding system includes a bookbinding apparatus having the accumulating tray for stacking a plurality of printed sheets thereon as the sheet bundle. When an interrupting factor is generated for interrupting a printing job, the printing is interrupted. Upon restarting the printing after the interrupting factor is cancelled, the printing apparatus determines whether the sheet bundle stacked on the accumulating tray is used for forming a bound book or not.

11 Claims, 21 Drawing Sheets

FIG. 17

| INTERRUPTION FACTOR | ACCUMULATED SHEET IS USED |
|---|---|
| SHORTAGE OF DEVELOPER | ○ |
| SHEET CONVEYING DEFECT | × |
| SHORTAGE OF SHEET | ○ |
| JOB STOP INSTRUCTION | ○ |

FIG. 18

| NUMBER OF STACKED SHEETS WHEN INTERRUPTED | ACCUMULATED SHEET IS USED |
|---|---|
| 1 TO 100 | × |
| 101 TO 200 | ○ |

| NUMBER OF STACKED SHEETS WHEN INTERRUPTED | ACCUMULATED SHEET IS USED |
|---|---|
| 1 TO 100 | × |
| 101 TO 180 | △<br>*OPERATOR ALLOWED TO DESIGNATE |
| 181 TO 200 | ○ |

BOOKBINDING APPARATUS AND BOOKBINDING METHOD

BACKGROUND OF THE INVENTION

1. Field of the Invention

The present invention relates to a bookbinding apparatus and a bookbinding method.

2. Description of the Related Art

Bookbinding apparatuses for biding a book using a sheet bundle composed of a plurality of pages of sheets (paper) have been known.

In a bookbinding apparatus, sheet bundles, each composed of a plurality of pages of sheets, are once accumulated in an accumulating space so as to produce a bound book by pasting and stapling the sheet bundle.

Various bookbinding methods have been proposed. As an example, a casing-in bookbinding method is known, in which the center of a cover sheet with a size larger than that of the sheet bundle (A4 sheet bundle versus A3 cover sheet, for example (Japanese Industrial Standard)) is glued at an end of the sheet bundle so as to wrap the cover sheet around the sheet bundle (see Japanese Patent Laid-Open No. 2004-155152, for example).

In the bookbinding apparatus, during printing, an interrupting factor for interrupting the printing may occur. In this case, after the printing has been interrupted and the interrupting factor has been resolved, the printing process may be restarted. When the interrupting factor for interrupting the printing is generated, part of sheets already printed may be accumulated in the accumulating space. Upon restarting the printing process, it may be economically desirable to use the already printed sheets for bookbinding to reduce paper waste. However, if any defect (sheet damage and contaminated paper) is present in the already printed sheets caused by the printing interruption or other reasons, a defective bound book may be produced as a result of using the defected printed sheets.

SUMMARY OF THE INVENTION

An embodiment of the present invention has been made in view of the problems mentioned above, and it provides an improved bookbinding apparatus and bookbinding method.

According to an aspect of the present invention, an embodiment is directed to a bookbinding apparatus and bookbinding method capable of selecting the priority, when an interrupting factor for interrupting a printing job is generated, between the use of the already printed sheet bundle accumulated in the accumulating space during printing interruption and no use of the already printed sheet bundle.

As many apparently widely different embodiments of the present invention can be made without departing from the spirit and scope thereof, it is to be understood that the invention is not limited to the specific embodiments thereof except as defined in the appended claims.

BRIEF DESCRIPTION OF THE DRAWINGS

The accompanying drawings, which are incorporated in and constitute a part of the specification, illustrate numerous embodiments, features and aspects of the invention and, together with the description, serve to explain the principles of the invention.

FIG. 17 is a table showing the printing interruption factors and treating methods for the factors according to an embodiment of the present invention.

FIG. 18 is a table showing the number of sheets stacked on an accumulation tray during the printing interrupting and treating methods for the number according to an embodiment of the present invention.

DESCRIPTION OF THE EMBODIMENTS

Figure 1:
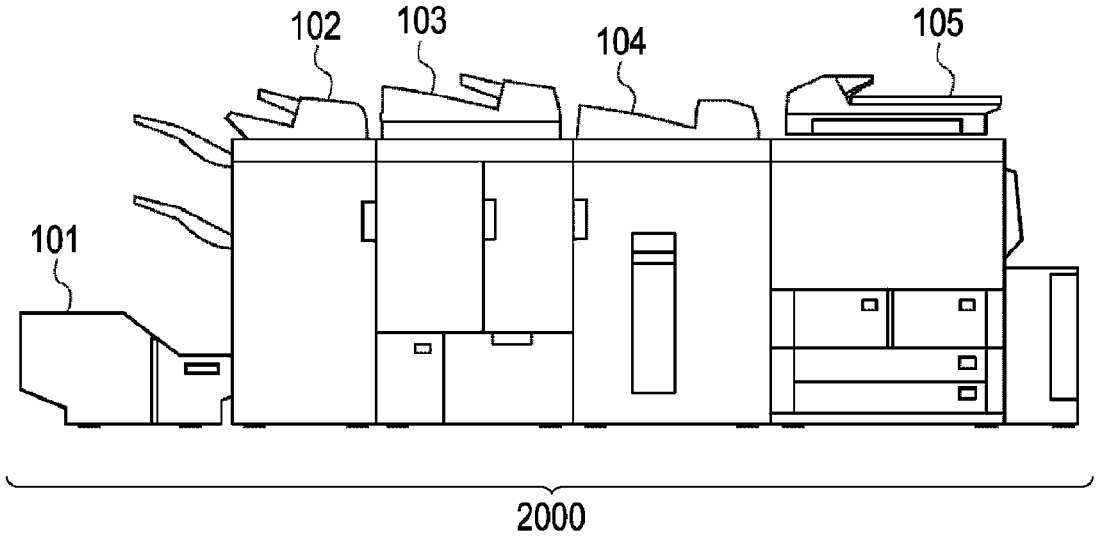
FIG. 1 is a drawing showing an exemplary configuration of a bookbinding system (bookbinding apparatus) according to an embodiment of the present invention.

The present invention will now be described in detail with reference to the drawings showing various embodiments thereof. In the drawings, elements and parts which are identical throughout the views are designated by identical reference numerals, and duplicate description thereof is omitted.

Embodiments of the present invention will be described below with reference to the drawings.

First Exemplary Embodiment (Entire Configuration of Bookbinding System (Bookbinding Apparatus))

FIG. 1 is a drawing of an exemplary configuration of a bookbinding system (bookbinding apparatus) according to an embodiment of the present invention.

Referring to FIG. 1, a printing apparatus 105 performs print processing on a sheet based on image data as well as conveys printed sheets to a stacker 104. The stacker 104 places the printed sheets conveyed from the printing apparatus 105 on a stack tray (not shown). The stacker 104 can also convey the sheets conveyed from the printing apparatus 105 to a casing-in bookbinding apparatus 103 without placing them on the stack tray. The casing-in bookbinding apparatus 103 places a plurality of sheets S conveyed from the printing apparatus 105 via the stacker 104 on an accumulating tray 42, which will be described later with reference to FIG. 8, as a sheet bundle S1. Then, the sheet bundle S1 placed on the accumulating tray 42 is wrapped with a cover sheet S2 placed on a cover sheet stack tray 70, which will be described later with reference to FIG. 8, so as to produce a casing-in book.

The casing-in bookbinding apparatus 103 can also convey the sheet S conveyed from the stacker 104 to a saddle-stitched bookbinding apparatus 102 without placing it on the accumulating tray 42. The saddle-stitched bookbinding apparatus 102 produces a saddle-stitched book by executing the saddle stitching on the sheet bundle S1 composed of a plurality of the sheets S conveyed from the printing apparatus 105 via the casing-in bookbinding apparatus 103. The saddle-stitched book produced in the saddle-stitched bookbinding apparatus 102 is conveyed to a paper cutter 101 for executing the cutting on the book.

In FIG. 1, the bookbinding system (bookbinding apparatus) 2000 includes the printing apparatus 105, the stacker 104, the casing-in bookbinding apparatus 103, the saddle-stitched bookbinding apparatus 102, and the paper cutter 101; alternatively, a different combination of devices may be employed. The bookbinding system (bookbinding apparatus) 2000 according to an embodiment can be constructed by combining at least the printing apparatus 105 with the casing-in bookbinding apparatus 103.

(Control Configuration of Printing Apparatus)

Figure 2:
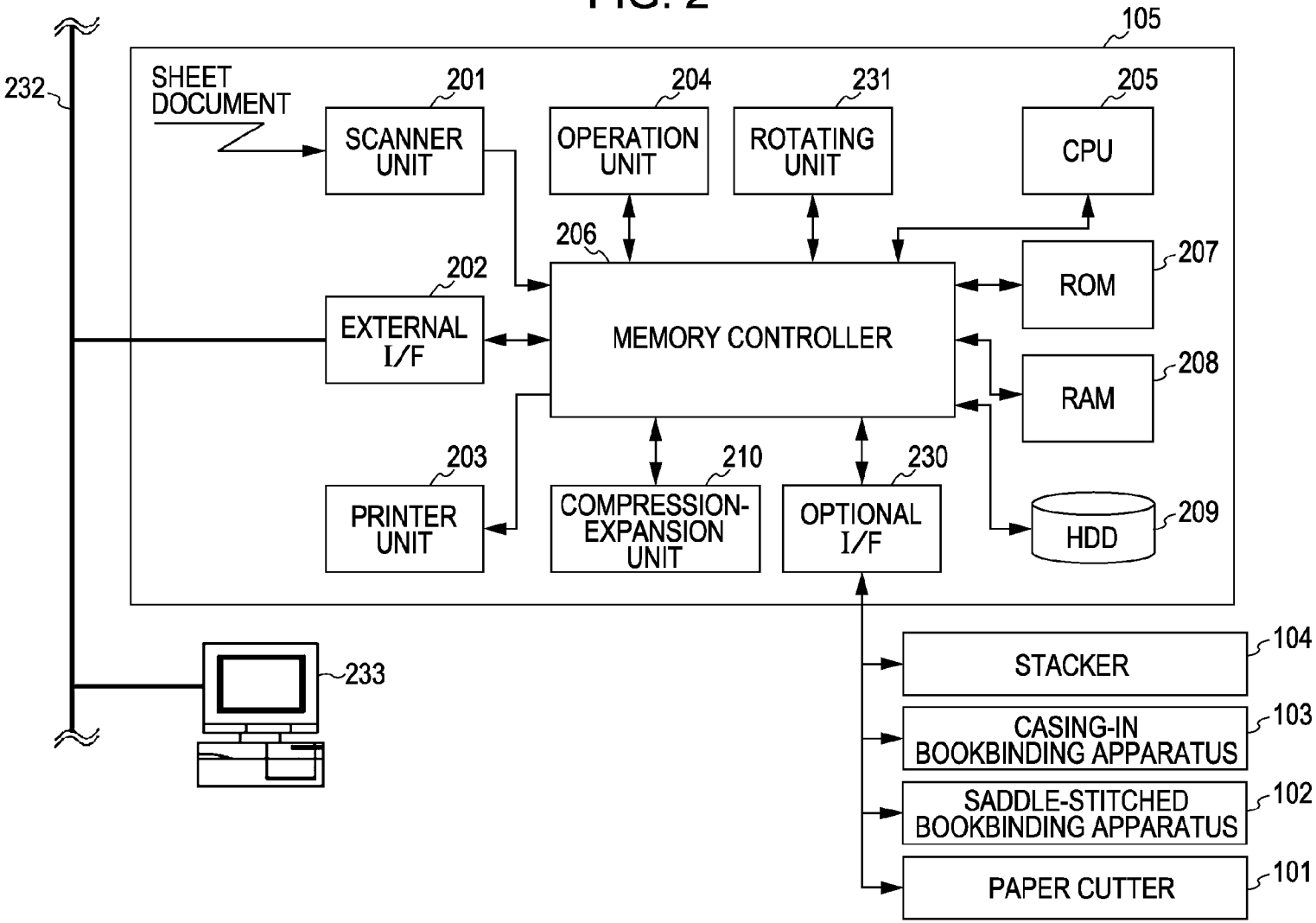
FIG. 2 is a block diagram showing components of a printing apparatus 105 according to an embodiment of the present invention.

FIG. 2 is a block diagram showing components of the printing apparatus 105 according to an embodiment of the present invention.

Referring to FIG. 2, a scanner unit 201 optically reads a plurality of manuscripts (images printed on a sheet such as paper) so as to produce image data as well as executes image processing, such as shading correction processing, on the read image data. Then, the scanner unit 201 stores the image data for a plurality of pages having the image processing executed thereon in a hard disk (HDD) 209 as one printing job. An external I/F 202 receives the printing job including the image data for a plurality of pages from the computer terminal 233 connected to the printing apparatus 105 via a network 232. A printer unit 203 performs printing on a plurality of sheets based on the printing job stored in the hard disk 209. Since the printing job is composed of image data of a plurality of pages, a plurality of the image data are printed on the plurality of the sheets, respectively. An operating unit 204 receives various instructions from an operator of the printing apparatus 105 so as to establish various settings on the printing apparatus 105 by transmitting the received instructions to a memory controller 206.

A CPU 205 writes the program read from an ROM 207 on an RAM 208 so as to control the entire bookbinding system 2000 including the printing apparatus 105 by executing the program using the RAM 208. In the ROM 207, a program is stored for interpreting PDL (page description language) code data received by the external I/F 202 from an external device as a printing job. Furthermore, in the ROM 207, a program is stored for producing data printable in the printer unit 203 after the PDL code data are interrupted. The memory controller 206 controls access to the ROM 207, the RAM 208, and the hard disk 209 from each element.

A compression-expansion unit 210 can execute compression processing on the image data stored in the RAM 208 and the hard disk 209 using various compression systems such as a JBIG (joint bi-level image experts group) and a JPEG (joint photographic experts group). The compression-expansion unit 210 can also execute to expand the image data compressed by the various compression systems.

A rotation unit 231 rotates image data when it is necessary upon executing the printing by transmitting the image data stored in the hard disk 209 to the printer unit 203. The rotation unit 231 can rotates the image data at an arbitrary angle such as 180°, at which the image data are reversed in the vertical direction, and 90°. The rotation angle of the rotating processing executed by the rotation unit 231 can be established from the CPU 205.

An option I/F 230 is an interface of the CPU 205 for communicating with the stacker 104, the casing-in bookbinding apparatus 103, the saddle-stitched bookbinding apparatus 102, and the paper cutter 101, which are optional apparatuses connected to the printing apparatus 105. The respective stacker 104, the casing-in bookbinding apparatus 103, the saddle-stitched bookbinding apparatus 102, and the paper cutter 101 have a CPU (not shown) for controlling its internal operation. Then, the CPU 205 of the printing apparatus 105 controls the stacker 104, the casing-in bookbinding apparatus 103, the saddle-stitched bookbinding apparatus 102, and the paper cutter 101 by transmitting a control command for controlling the CPU of each optional apparatus via the option I/F 230.

(Configuration of Printing Apparatus)

Figure 3:
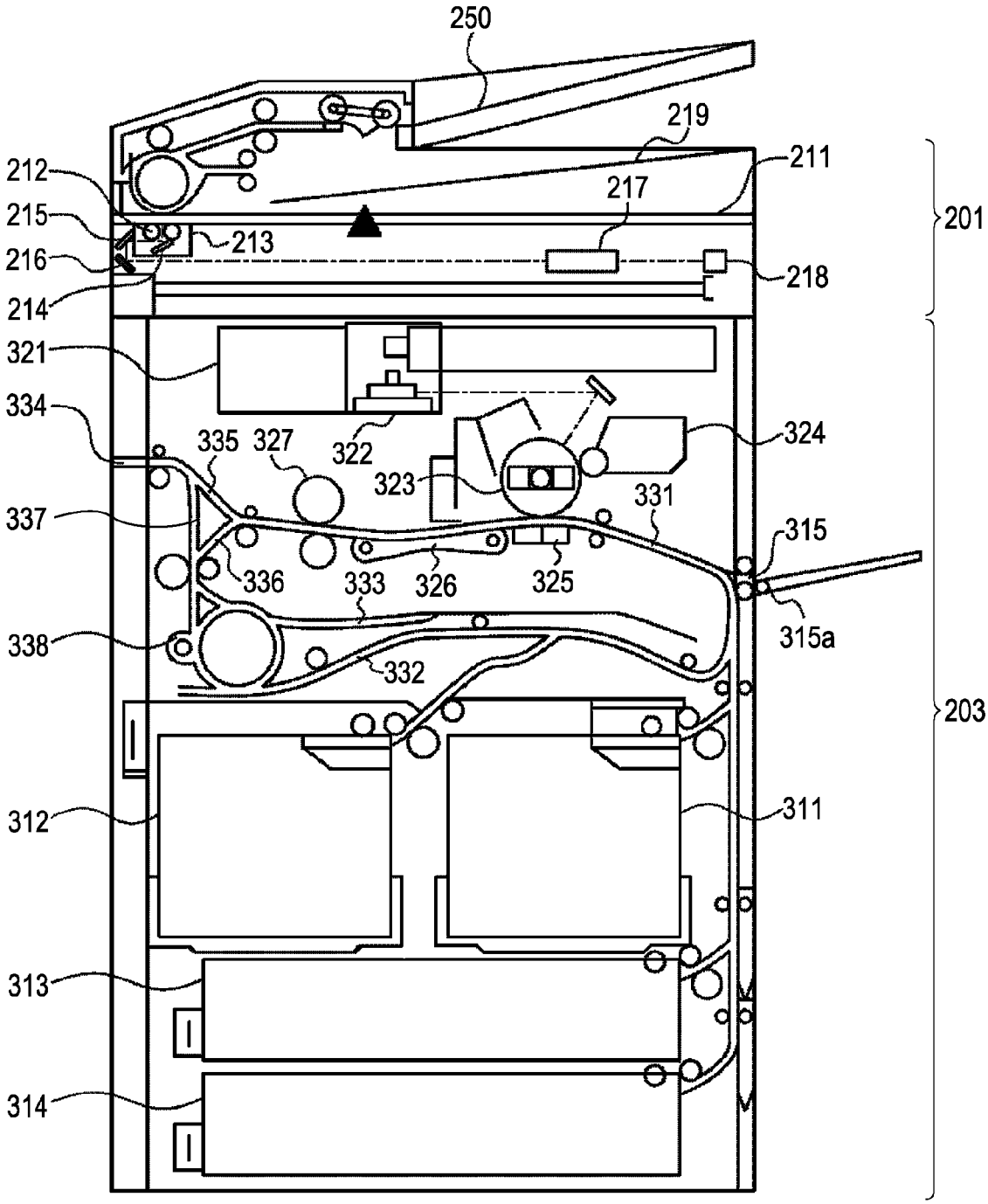
FIG. 3 is a sectional view of the printing apparatus 105 according to an embodiment of the present invention.

Next, with reference to FIG. 3, the configuration of the printing apparatus 105 according to an embodiment will be described.

The printing apparatus 105 generally includes the scanner unit 201 and the printer unit 203. The scanner unit 201 feeds sheets stacked on a document feed unit 250 one by one sequentially in a stacking order from the top to a platen glass 211. Then, the document feed unit 250 discharges the sheet on a discharge tray 219 after the reading operation by the scanner unit 201 is finished. When a document sheet is conveyed on the platen glass 211, the scanner unit 201 lights a lamp 212 so as to start an optical unit 213 to move, so that the document sheet is scanned from the below while being radiated. The reflected light from the document is led to a CCD image sensor (referred to as a CCD below) 218 via a plurality of mirrors 214 to 216 and a lens 217, so that scanned document images are read by the CCD 218 as image data. The image data read by the CCD 218 are stored in the hard disk 209 after a predetermined image processing is performed thereon.

The printer unit 203 outputs a laser beam corresponding to the image data read out of the hard disk 209 from a laser radiation unit 322 driven by a laser driver 321. On a photosensitive drum 323 radiated with the laser beam, electrostatic latent images are formed in accordance with the laser beam. A developing unit 324 allows a developer (toner, for example) to adhere on the electrostatic latent images.

On the other hand, a sheet S is fed from any one of cassettes 311 to 314 and a manual feed tray 315 simultaneously with the irradiation initiation of the laser beam, and conveyed to a transfer unit 325 via a conveying path 331. The manual feed tray 315 is provided with a sheet detection sensor 315*a* for detecting a sheet s placed thereon. The transfer unit 325 transfers the developer adhered on the photosensitive drum 323 onto the sheet S. The sheet S having the developer transferred thereon is conveyed by a conveying belt 326 to a fixing unit 327 for being heated in the fixing unit 327. The developer on the sheet S is thereby fixed on the sheet S. The sheet S having the developer fixed thereon is conveyed to the stacker 104 via conveying paths 335 and 334. Upon conveying the sheet S to the stacker 104, when the sheet S is conveyed after the sheet S is inverted, the CPU 205 controls the printer unit 203 in leading the sheet S to conveying paths 336 and 338. Thereafter, the sheet S is conveyed in the reverse direction to the stacker 104 via conveying paths 337 and 334.

(Configuration of Casing-In Bookbinding Apparatus)

Figure 8:
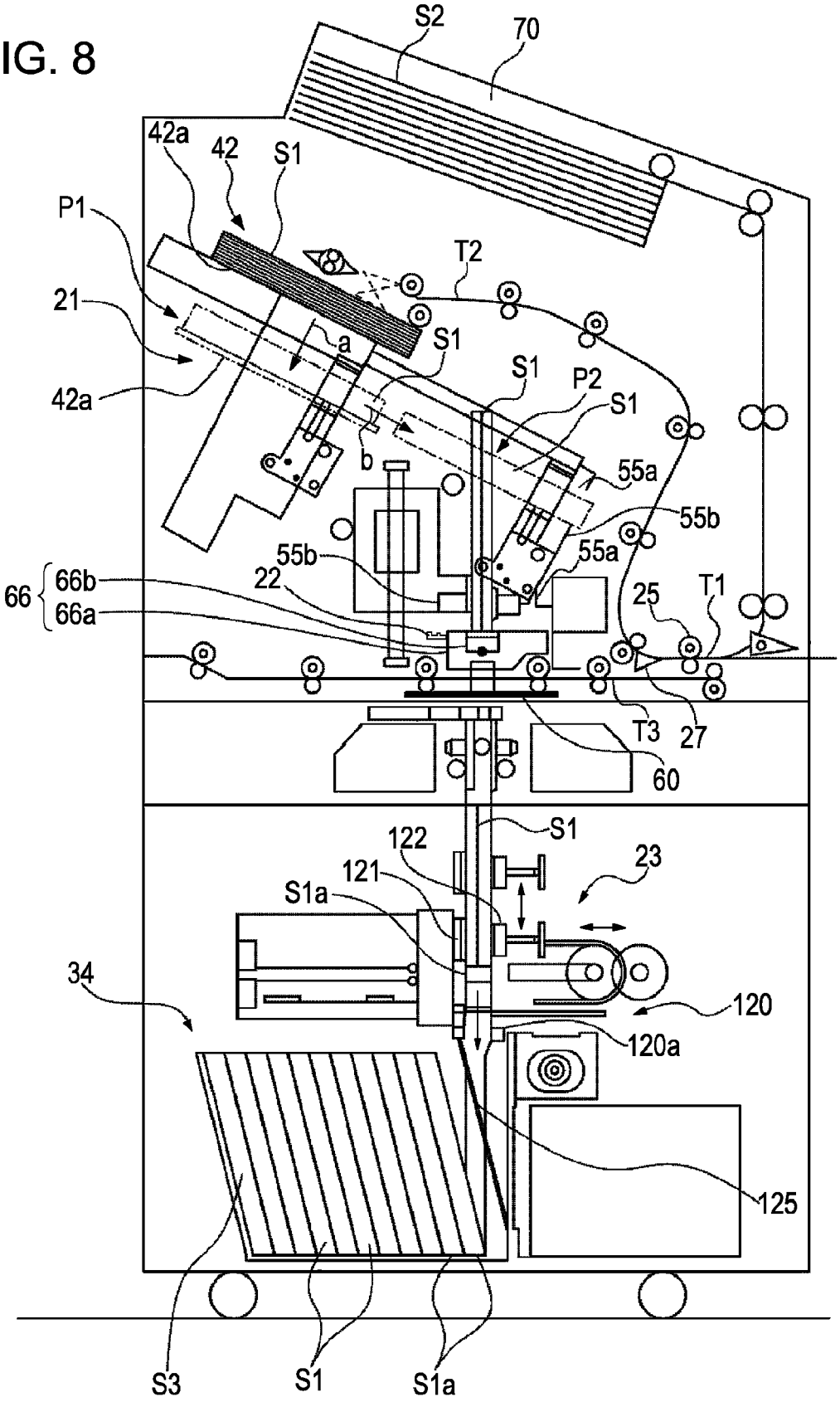
FIG. 8 is a drawing showing the configuration of a casing-in bookbinding apparatus according to an embodiment of the present invention.

Next, with reference to FIG. 8, an exemplary configuration of the casing-in bookbinding apparatus 103 will be described.

The casing-in bookbinding apparatus 103 includes at least a conveying and aligning unit 21 for conveying and aligning the sheet S, an adhesive coating unit 22, and a cutting unit 23. The cutting unit 23 can cut the sheet bundle S1 along three sides other than the bonded side.

The conveying and aligning unit 21 includes a first conveying path T1 for conveying the sheet S conveyed via the stacker 104 and second and third conveying paths T2 and T3 branched from the first conveying path T1. The first conveying path T1 is provided with conveying roller pairs 25. On the downstream side of the conveying roller pair 25, a switching flapper 27 is provided at a bifurcation point between the second conveying path T2 and the third conveying path T3 for switching the conveying path.

In such a conformation of the conveying paths, when the CPU 205 selects a normal discharge mode, the sheet S, which is conveyed into the casing-in bookbinding apparatus 103 from the printing apparatus 105 via the first conveying path T1, is led to the third conveying path T3 by the switching flapper 27. Then, the sheet S is conveyed to the saddle-stitched bookbinding apparatus 102 via a plurality of the conveying roller pairs 25 provided in the third conveying path T3. On the other hand, when the CPU 205 selects a casing-in bookbinding mode, the sheet S is lead to the second conveying path T2 by the switching flapper 27, and further conveyed onto the accumulating tray 42 forming the aligning area of the conveying and aligning unit 21. The accumulating tray 42 includes a receiving unit 42*a* for receiving the sheet S. A predetermined number of the sheets S are placed in an inclined state on the receiving unit 42*a* so as to form one sheet bundle S1.

When a sheet bundle S1 composed of a predetermined number of sheets is formed, the receiving unit 42*a* is downwardly moved by a predetermined distance toward a position P1 (direction of arrow a), and then, it is positioned at a position P2 by being moved in a direction perpendicular to the initial moving direction (direction of arrow b) (diagonally downward) by a predetermined distance. The receiving unit 42*a* is moved by a movement mechanism (not shown in detail).

At the position P2, there are provided grippers (conveying means) 55*a* and 55*b* for holding ends of the sheet bundle S1 placed on the receiving unit 42*a*. The grippers 55*a* and 55*b* direct the gripped sheet bundle S1 in substantially the vertical direction (erect the sheet bundle S1 in substantially the vertical direction). Then, while the substantial vertical direction being maintained (one side of the sheet bundle S1, at which an adhesive is to be applied as will be described later, is downward directed), the grippers 55*a* and 55*b* downward move the sheet bundle S1 toward an adhesive applying unit 22.

Then, the sheet bundle S1 is substantially vertically positioned at a predetermined position on a coating region in the movement path of a bonding unit 66. Then, the bonding unit 66, which has been put at a standby position, is moved to a predetermined starting position of the coating region. Thereafter, in a state that a coating roller is normally rotated so as to come in contact with the edge side of the sheet bundle S1, the bonding unit 66 is moved relative to the sheet bundle S1 from the starting position toward a predetermined turn back position. Thereby, an adhesive is uniformly applied at the edge side of the sheet bundle S1 by the coating roller having the adhesive in a container 66*a* carried on its surface.

When the bonding unit 66 reaches the above-mentioned turn back position, the coating roller is stopped normally rotating while the bonding unit 66 is stopped moving. Thereafter, the bonding unit 66 starts moving from the predetermined turn back position toward the starting position in a state that the coating roller is reversely rotated for this time. At the time when the bonding unit 66 again reaches the starting position, the coating roller is stopped reverse rotating as well as the bonding unit 66 is stopped moving. When such a reciprocating movement is repeated twice, for example, the adhesive coating is completed.

Upon completion of applying the adhesive on the edge side of the sheet bundle S1, the bonding unit 66 is moved to the standby position or a replenishing position so as to secure the conveying path for the sheet bundle S1. Then, along the substantial vertical conveying path (in an intersecting direction with the movement direction of the bonding unit 66), the sheet bundle S1 gripped by the grippers 55*a* and 55*b* is downward moved toward a cover sheet bonding unit 60.

During applying the adhesive to the edge side of the sheet bundle S1 in such a manner, a cover sheet S2 has been already conveyed to the cover sheet bonding unit 60 from a cover-sheet accumulation tray 70 and placed on standby. The back side of a backbone region 1002 is positioned at a predetermined position of the cover sheet bonding unit 60 intersecting the substantial vertical conveying path of the sheet bundle S1. The edge side of the sheet bundle S1 having the adhesive coated thereon is pushed onto the positioned cover sheet S2 in the vertical direction from the above by the grippers 55*a* and 55*b*. In this state, the sheet bundle S1 is further moved in the downward vertical direction by the grippers 55*a* and 55*b* leaving its edge side being attached to the cover sheet S2 due to the adhesive, so that the sheet bundle S1 is pushed onto a slidable abutment plate located below the cover sheet bonding unit 60. Then, the cover sheet S2 and the sheet bundle S1 are pressed from both sides in an abutted state to the abutment plate by slidable back-folding plates. Thereby, creases are formed on the cover sheet S2 in accordance with the thickness of the sheet bundle S1.

Then, after the abutment plate slides outside so as to form a conveying path for the sheet bundle S1, the grippers 55*a* and 55*b* deliver the sheet bundle S1 with the cover sheet S2 bonded thereon over to the cutting unit 23 in the below.

Next, the cutting unit 23 will be described.

Reference numeral 120 denotes a cutting unit; numeral 121 a rotating table; numeral 122 a rotatable gripper for gripping the sheet bundle S1 on the rotating table 121. The cutting unit 120 includes a cutting blade 120*a*, a movable presser bar for pressurizing the end of the sheet bundle S1 during cutting, a fixed presser bar, and a presser bar movement mechanism for driving these bars.

When the sheet bundle S1 with the cover sheet S2 bonded thereon is delivered to the cutting unit 23 by the grippers 55*a* and 55*b*, the sheet bundle S1 is conveyed toward the cutting blade 120*a* in the vertical direction. When the sheet bundle S1 is conveyed to the cutting blade 120*a*, the gripper 122 is driven so that the sheet bundle S1 is pinched between the gripper 122 and the rotating table 121.

Then, the cutting blade 120*a* moves to a predetermined position for waiting to form a space necessary for the rotation and movement of the sheet bundle S1 on the basis of the thickness information of the sheet bundle S1. Then, the cutting blade 120*a* cuts one edge side of the sheet bundle S1.

When the one edge side is cut, the presser bar and the cutting blade 120*a* move again to a predetermined position for waiting to form a space necessary for the rotation and movement of the sheet bundle S1 on the basis of the thickness information of the sheet bundle S1. Then, the rotating table 121 and the gripper 122 are again driven so that the sheet bundle S1 clamped between the rotating table 121 and the gripper 122 is rotated (by an angle of 180°) and moved to a position capable of cutting an edge side to be cut by the cutting blade 120*a*. Then, the cutting blade 120*a* cuts one edge side of the sheet bundle S1. By the same operation, the third edge side of the sheet bundle S1 is cut.

Upon completion of cutting the three edge sides in such a manner, the rotating table 121 is returned to an original position, and the sheet bundle S1 clamped between the rotating table 121 and the gripper 122 is conveyed to an accommodation unit 34 via a discharge roller 123. In this case, the sheet bundle S1 discharged by the discharge roller 123 is compressed into the accommodation unit 34, and is accommodated in a substantially vertically erected state while downwardly directing the edge side having the adhesive coated thereon. In the description below, the sheet bundle S1 with the cover sheet S2 bonded thereto is referred to as a bound book S3.

(Configuration of Operation Unit)

Next, with reference to FIG. 4, the operation unit 204 included in the printing apparatus 105 will be described.

The operation unit 204 includes a hard key group 4-240 having various hard keys 4-241 to 4-246. The operation unit 204 also includes a dot-matrix liquid crystal display 4-250 made of a liquid crystal display device. The liquid crystal display 4-250 includes a touch panel formed in the front. When an operator of the printing apparatus 105 pushes the key display, the operation unit 204 detects the key entry so as to send a signal corresponding to the key entry to the CPU 205. The CPU 205 executes the operation in accordance with the received signal by controlling the printing apparatus 105 on the basis of the program stored in the ROM 207.

The key 4-243 is a power supply key for turning on/off the power supply; the key 4-244 an energy saving key for turning on/off a safe mode; the start key 4-241 a key for allowing an operator to instruct the scanner unit 201 to start various processes such as reading images on a document; and a stop key 4-242 a key for allowing an operator to instruct the bookbinding system 2000 including the printing apparatus 105 to stop the operation being executed.

The key group 4-245 includes ten keys 0 to 9 for the entry of the number of copies, the zoom magnification, and so forth; and a clear key for clearing the entry. The number of copies inputted with the key group 4-245 is displayed on the liquid crystal display 4-253. The reset key 4-246 is a key for returning the setting conditions, which are set by an operation via the liquid crystal display 4-250 and the hard key group 4-240, to an original state.

The liquid crystal display 4-250 displays operation states of the bookbinding system 2000 by the instruction from the CPU 205. On the liquid crystal display 4-250, touch keys are also displayed. In the liquid crystal display 4-250, the key 4-252 is for selecting a cassette having the sheet S placed thereon for use in printing by the printing apparatus 105. When the key 4-252 is pushed by an operator, the CPU 205 controls the operation unit 204 in displaying a sheet selection screen shown FIG. 5A on the liquid crystal display 4-250.

Figure 4:
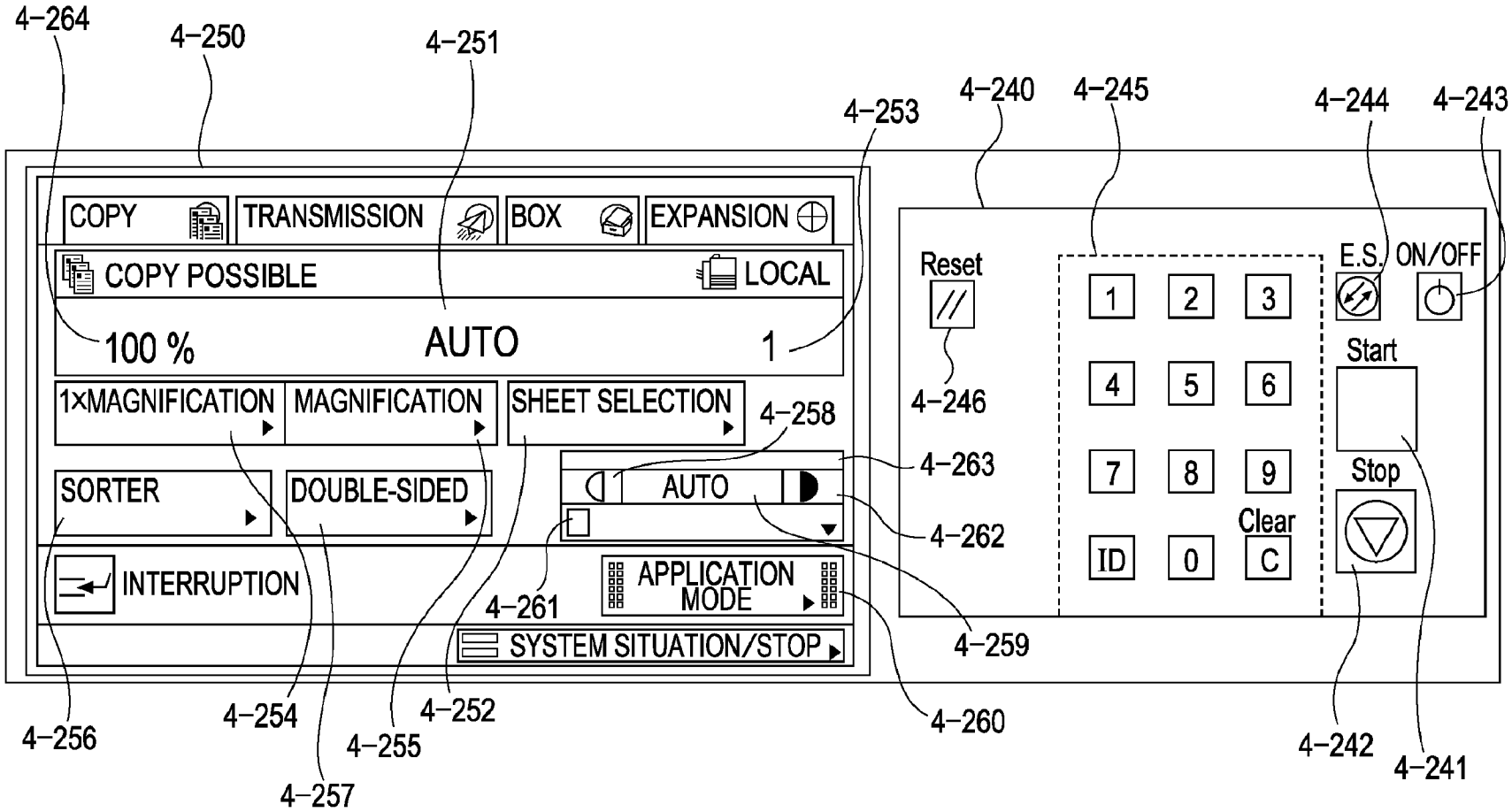
FIG. 4 is a drawing showing the configuration of an operation unit 204 included in the printing apparatus 105 according to an embodiment of the present invention.
Figure 5A:
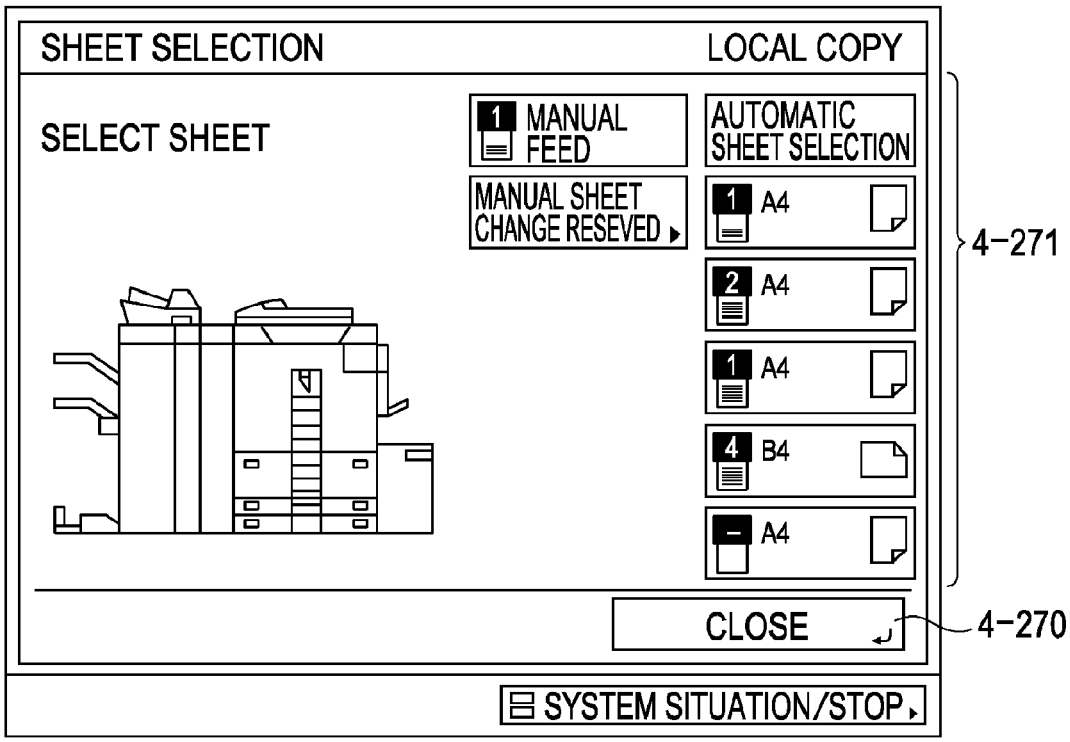
FIGS. 5A to 5D are drawings showing examples of operating screens displayed in the liquid crystal display shown in FIG. 4 according to an embodiment of the present invention.

With a key group 4-271 of the sheet selection screen shown in FIG. 5A, any one of the cassettes 311 to 315 is selected for use in printing. When a close key 4-270 is pushed by an operator, the CPU 205 closes this display screen so as to return it to the display screen of FIG. 4 for displaying the selected cassette on the display 4-251.

Keys 4-258 and 4-262 shown in FIG. 4 are for adjusting the density. The CPU 205 makes the density to be adjusted by these keys display on a display 4-263. A key 4-259 is for turning on/off the automatic density adjusting function; a key 4-261 is for setting a mode such as a picture mode and a text mode.

Figure 5B:
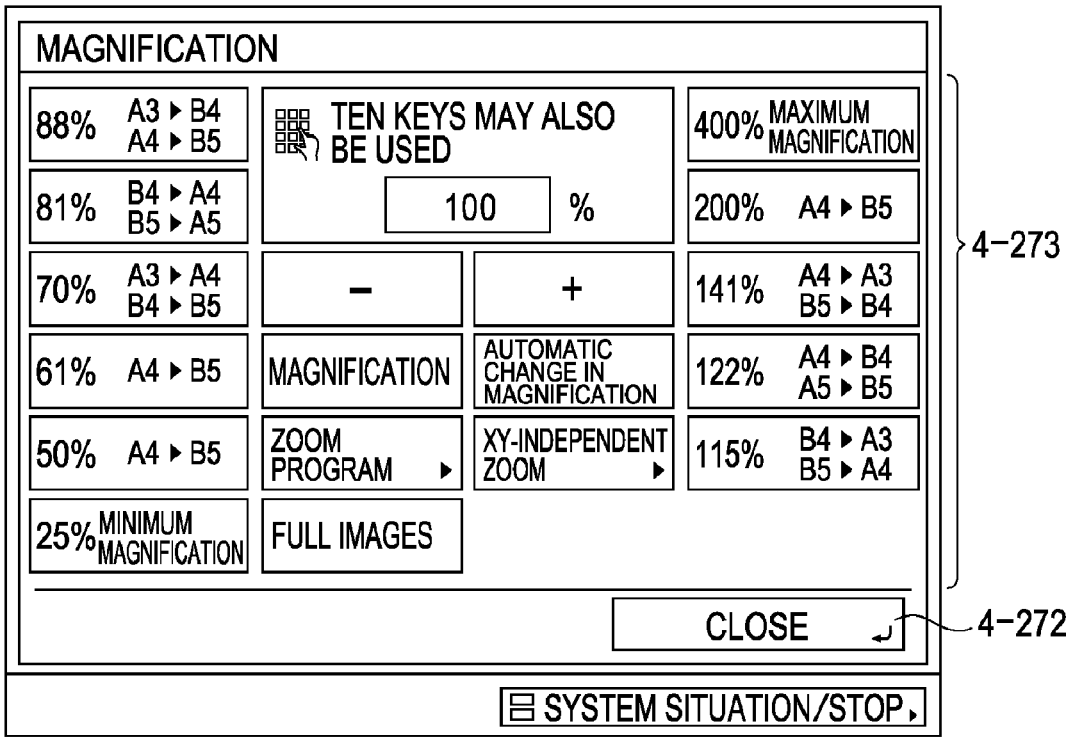

Keys 4-254 and 4-255 are for setting the direct and the contraction/expansion, respectively. When the key 4-255 is pushed down, the CPU 205 allows the liquid crystal display 4-250 to display a magnification display screen shown in FIG. 5B, enabling the magnification to be set in detail. When the magnification is selected with a key group 4-273 of the magnification display screen shown in FIG. 5B and a close key 4-272 is pushed down by an operator, the CPU 205 closes this display screen so as to return it to the display screen of FIG. 4 for displaying the set magnification on the display 4-264.

Figure 5C:
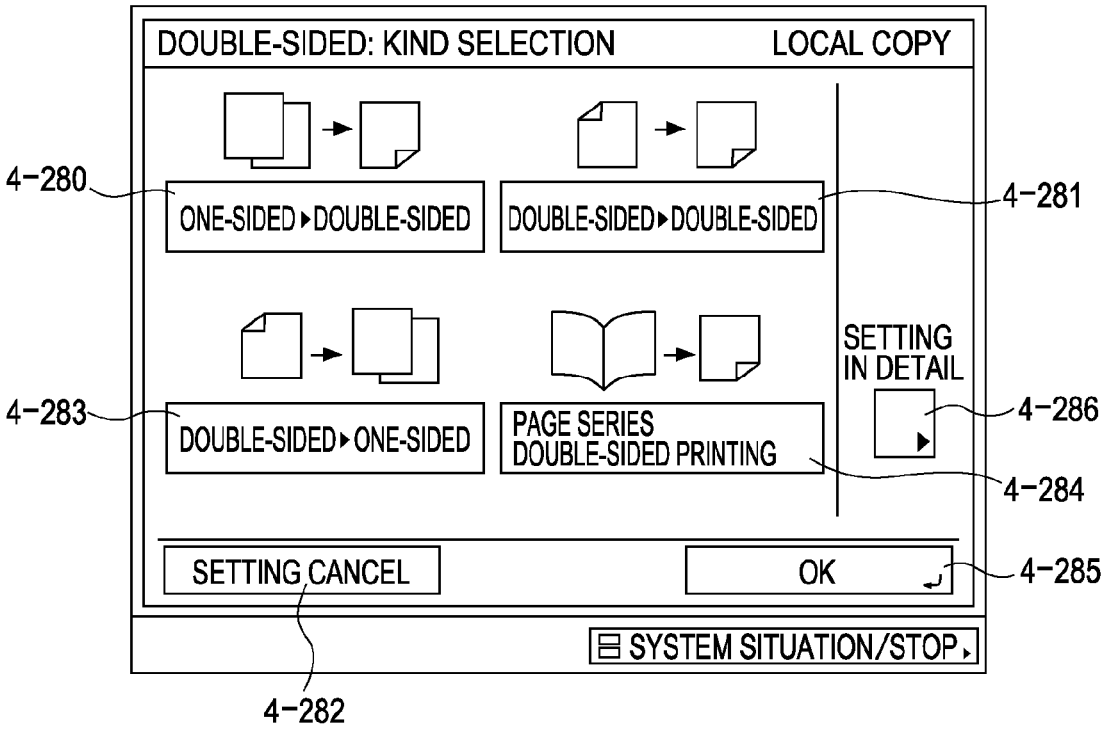

A key 4-257 is a double sided key, and when the key 4-257 is pushed down, the CPU 205 allows the liquid crystal display 4-250 to display a double-sided printing setting screen shown in FIG. 5C. The setting the double-sided printing will be described below with reference to FIG. 5C.

Referring to FIG. 5C, a key 4-280 is for setting the double-sided printing on a sheet using a document having images printed only on one side (referred to as an one-sided document below); a key 4-281 is for setting the double-sided printing on a sheet using a document having images printed on both sides (referred to as a double-sided document below); a key 4-283 is for setting the one-sided printing on a sheet using a double-sided document; and a key 4-284 is for setting the page series double-sided printing.

A key 4-285 is for making effective the setting set by an operator in the double-sided printing setting screen shown in FIG. 5C. When this key is pushed down, the CPU 205 makes effective the setting in the double-sided printing setting screen shown in FIG. 5C so as to return the liquid crystal display 4-250 to the screen of FIG. 4. A key 4-282 is for canceling the setting set in FIG. 5C, and when this key is pushed down, the CPU 205 cancels the setting in the double-sided printing setting screen shown in FIG. 5C so as to return the liquid crystal display 4-250 to the screen of FIG. 4.

A key 4-286 is for enabling a user to set the detail. When the key 4-286 is pushed down by the user, the CPU 205 allows the liquid crystal display 4-250 to display the screen shown in FIG. 5D. The detailed setting of the double-sided printing will be described below with reference to FIG. 5D.

Figure 5D:
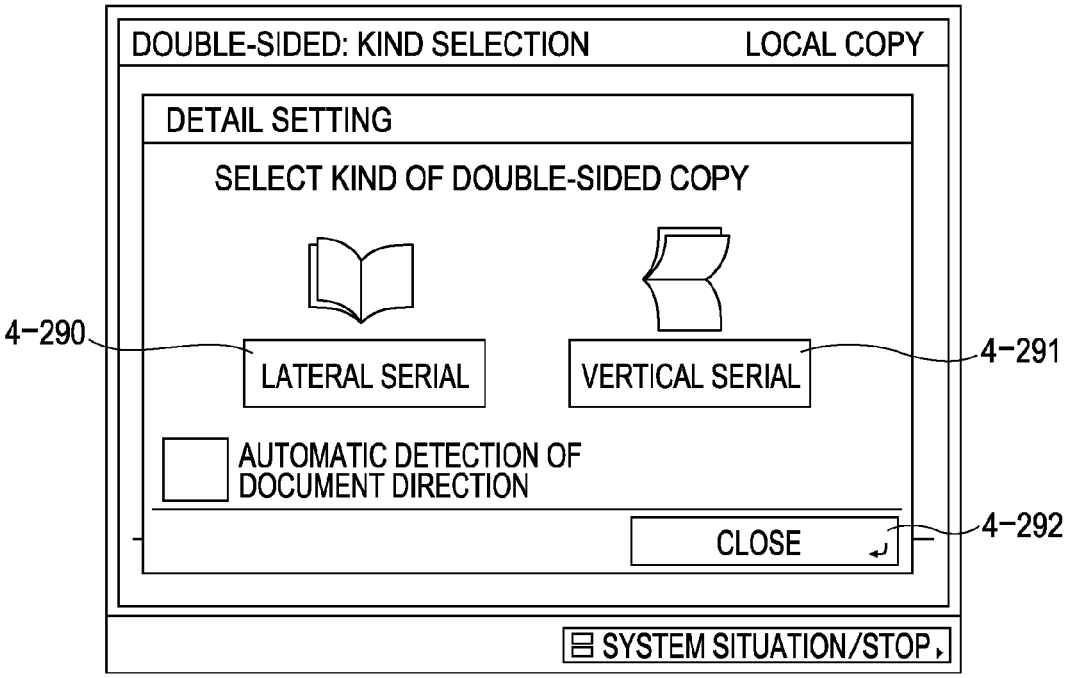

Referring to FIG. 5D, a key 4-290 is a setting key for making the sheet S printed by the printing apparatus 105 lateral serial pictures; a key 4-291 is a setting key for making the sheet S vertical serial pictures. When with the key 4-290 or 4-291, the kind of the double-sided printing is selected and a close key 4-292 is pushed down, the CPU 205 closes this display screen and returns the liquid crystal display 4-250 to the screen of FIG. 5C.

As shown above, with the double-sided printing setting screen shown in FIG. 5C and the double-sided printing detailed setting screen shown in FIG. 5D, the double-sided printing is enabled.

A key 4-256 on the displayed screen of FIG. 4 is a sorter key for allowing a user to instruct the display of the operation unit 204 to display the setting screen for instructing a sheet processing apparatus 230 to execute the sheet processing by the user.

When the key 4-256 is pushed down by an operator, the CPU 205 shifts the liquid crystal display 4-250 of the operation unit 204 to a screen shown in FIG. 6C, which will be described later. Then, the CPU 205 brings up candidates (casing-in binding and saddle-stitching binding) of the sheet processes executable by the sheet processing apparatus 230 to the operator.

Figure 6A:
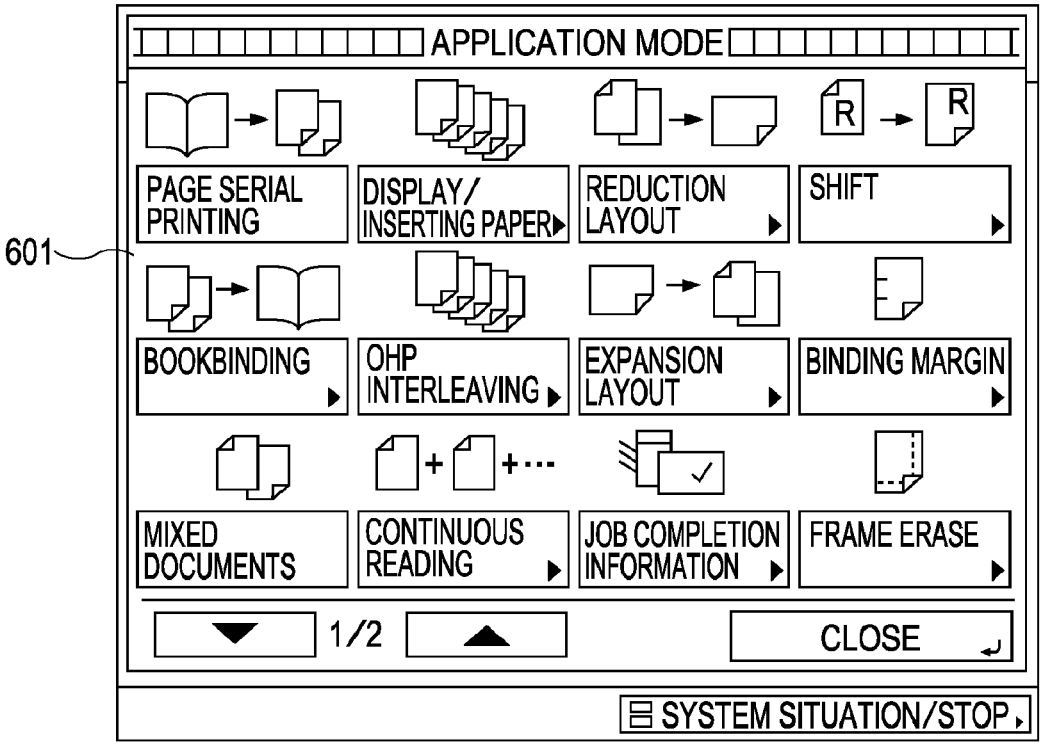
FIGS. 6A to 6C are drawings showing examples of operating screens displayed in the liquid crystal display shown in FIG. 4 according to an embodiment of the present invention.
Figure 6B:
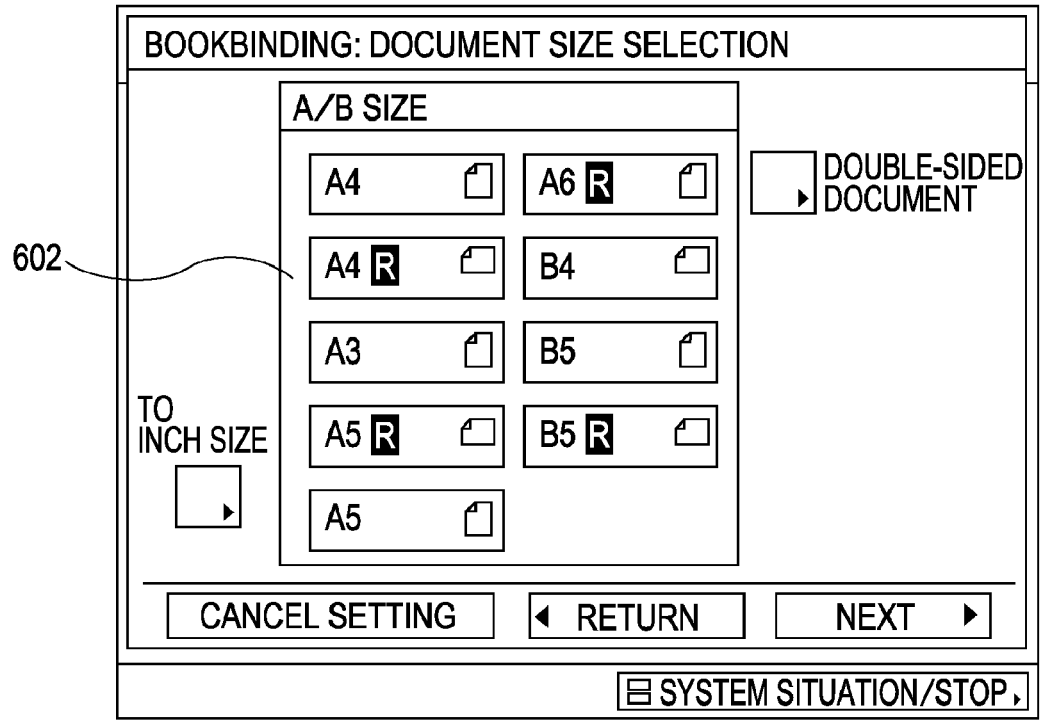
Figure 6C:
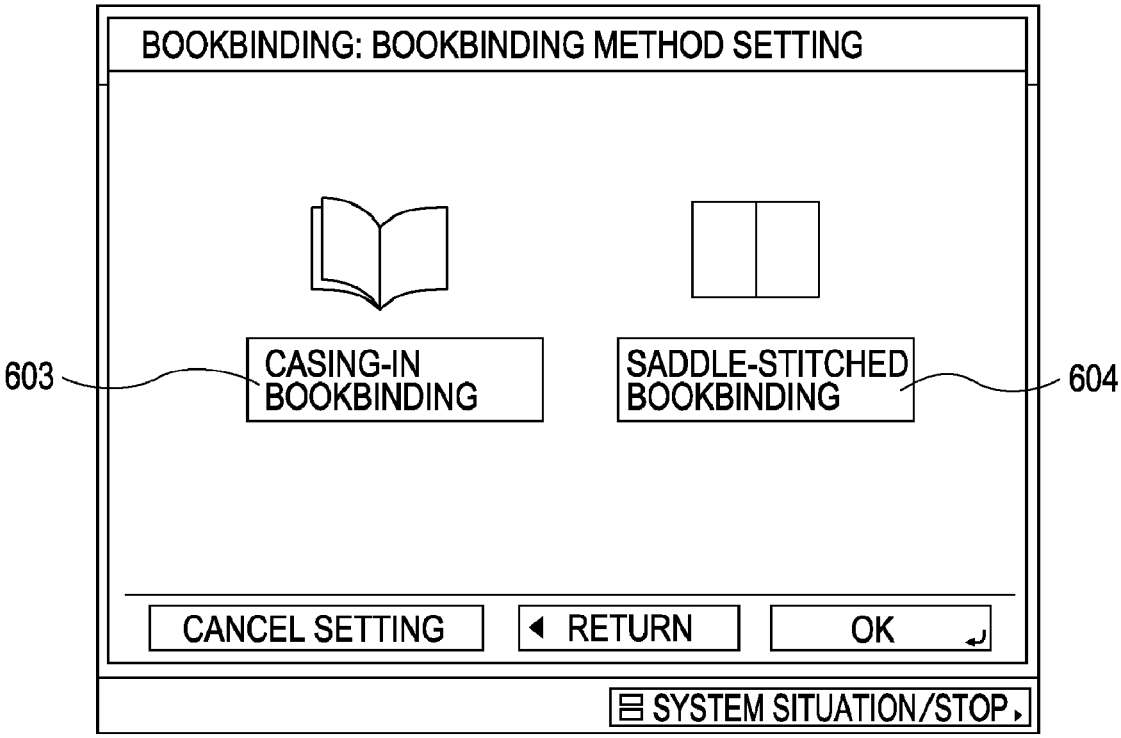

The CPU 205 receives the instruction to execute desired sheet processing from an operator via the sheet processing setting screen shown in FIG. 6C. Then, the CPU 205 controls the bookbinding system 2000 in executing the bookbinding processing selected by the operator via the sheet processing setting screen.

The procedure of the bookbinding setting will be described below with reference to FIGS. 6A to 6C.

Methods for inputting image data for a plurality of pages used in printing the sheet S include a method inputting the image data from the scanner unit 201 (referred to as a first input method) and a method inputting the image data from the computer terminal 233 (referred to as a second input method). Then, in the description below, the two inputting methods will be described, respectively.

(Procedure of Bookbinding Setting—First Inputting Method)

FIGS. 6A to 6C are drawings of examples of an operation screen displayed on the liquid crystal display 4-250 of the operation unit 204 shown in FIG. 4.

FIG. 6A shows an application mode screen displayed on the liquid crystal display 4-250 by the CPU 205 in accordance with the pushing by an operator of the key 4-260 on the operation screen shown in FIG. 4.

The key 601 on the screen of FIG. 6A is for setting a bookbinding mode (casing-in bookbinding or saddle-stitched bookbinding). When the key 601 is pushed down by an operator, the CPU 205 allows the liquid crystal display 4-250 to display the document size selection screen shown in FIG. 6B.

FIG. 6B is an operation screen for designating the document size used in printing the sheet S to be a regular text of the bound book S3 bound in a bookbinding mode. A key group 602 on the screen of FIG. 6B includes designating keys for allowing an operator to set the size of the document sheet to be a regular text. For example, when "A4 size" on the screen of FIG. 6B is pushed down and then, "next" is pushed down, the CPU 205 allows the liquid crystal display 4-250 to display the operation screen shown in FIG. 6C.

FIG. 6C is an operation screen for setting the kind of the bookbinding. By pushing down a casing-in bookbinding key 603 on the screen of FIG. 6C, an operator can designate the casing-in bookbinding. On the other hand, by pushing down a saddle-stitched bookbinding key 604 on the screen of FIG. 6C, the operator can designate the saddle-stitched bookbinding. When the operator designates the casing-in bookbinding by pushing down the casing-in bookbinding key 603, the CPU 205 allows the liquid crystal display 4-250 to display the screen shown in FIG. 7A.

Figure 7A:
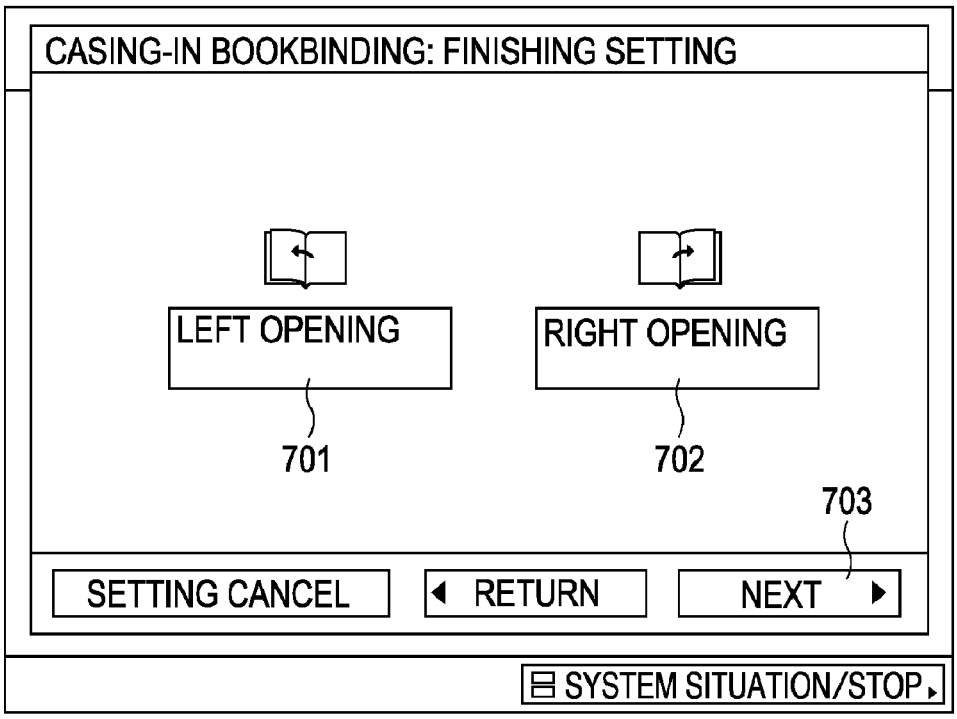
FIGS. 7A to 7D are drawings showing examples of operating screens displayed in the liquid crystal display shown in FIG. 4 according to an embodiment of the present invention.

FIG. 7A is a screen for designating the bound book S3 formed as whether left opening or right opening. When a left opening key 701 is pushed down and then, a key 703 is pushed, the CPU 205 designates a left opening bookbinding mode. On the other hand, when a right opening key 702 is pushed down and then, the key 703 is pushed, the CPU 205 designates a right opening bookbinding mode. Then, by the pushing down the key 703, the CPU 205 allows the liquid crystal display 4-250 to display the screen shown in FIG. 7B.

Figure 7B:
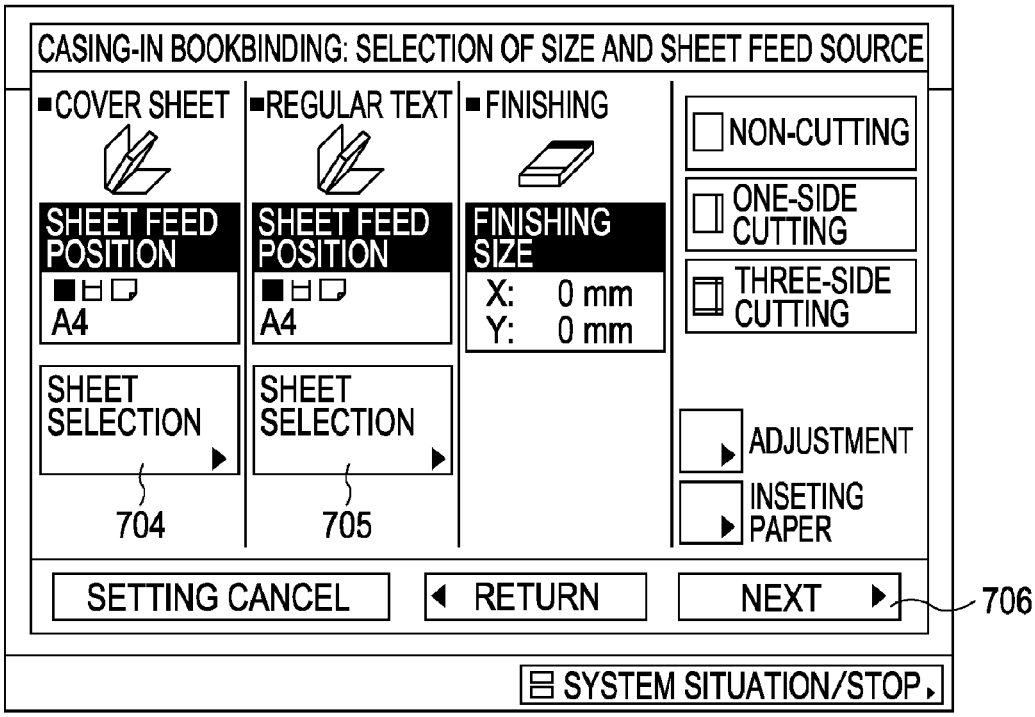

FIG. 7B is a screen for designating the size of the cover sheet S2 used as a cover sheet for forming the bound book S3 and the feed source of the cover sheet S2. According to the embodiment, since the cover sheet S2 is placed on the cover sheet stack tray 70, after a sheet selection key 704 is pushed, with the screen (not shown) displayed on the liquid crystal display 4-250, the cover sheet stack tray 70 is to be designated. FIG. 7B is a screen for designating the size of the sheet S used for a regular text for forming the bound book S3 and also for the feed source of the sheet S. When the sheet selection key 704 is pushed down, the CPU 205 allows the liquid crystal display 4-250 to display the screen shown in FIG. 5A and makes the operator designate to feed the sheet S from any one of the cassettes 311 to 315. When the key 706 pushed down after the cover sheet S2 and the sheet S are selected via the sheet selection keys 704 and 705, the CPU 205 establishes the setting about the cover sheet S2 and the sheet S. Then, the CPU 205 allows the liquid crystal display 4-250 to display the screen shown in FIG. 7C.

Figure 7C:
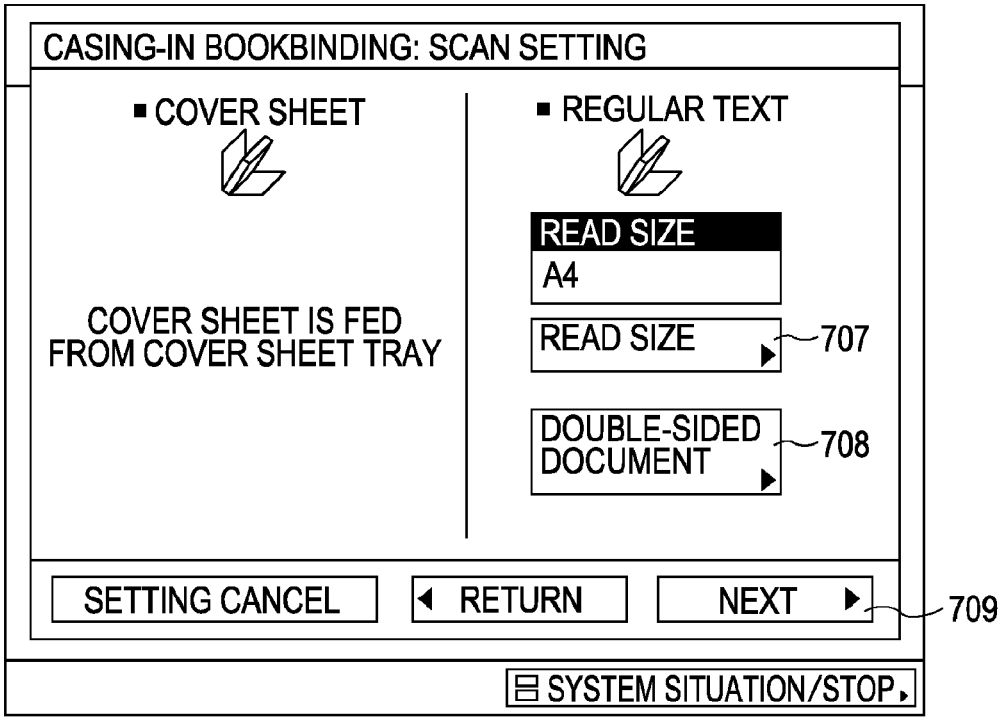

FIG. 7C is a screen for setting the reading of the document sheet, by the scanner unit 201, used in printing the sheet bundle S1 to be a regular text of the bound book S3. A key 707 is for setting the size of the document sheet used in printing the sheet bundle S1. When the key 707 is pushed down, the CPU 205 allows the screen of FIG. 6B to be displayed and an operator to designate the size of the document sheet. When the operator designates the size of the document size, the CPU 205 fixes the document size. A key 708 is for designating that the document used in printing the sheet bundle S1 is the double-sided printed document sheet. When the operator pushes the key 708 down, the scanner unit 201 reads the both sides of the document as image data so as to obtain the image data for two pages from one document sheet. Then, after a key 709 is pushed down, the CPU 205 allows the liquid crystal display 4-250 to display the screen shown in FIG. 7D.

Figure 7D:
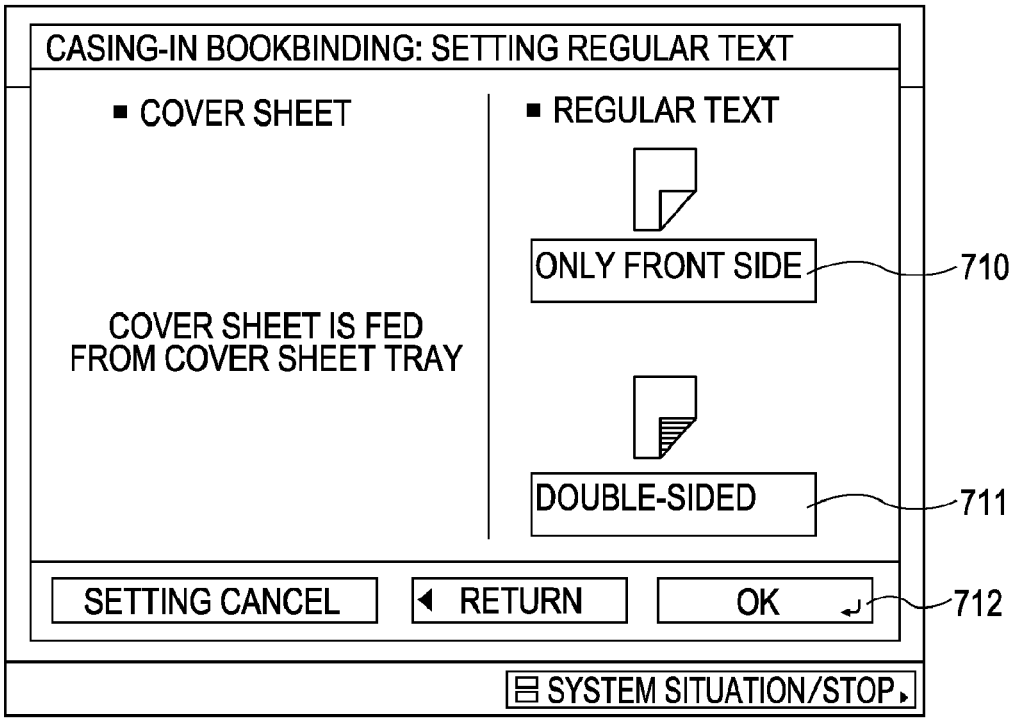

FIG. 7D is a screen for setting that whether the sheet bundle S1 to be a regular text of the bound book S3 is double-sidedly printed using a re-feed sheet conveying path 332 or not. When a key 710 is pushed down, the CPU 205 allows the printer unit 203 to print only one side of the sheet S. On the other hand, when a key 711 is pushed down, the CPU 205 allows the printer unit 203 to print both sides of the sheet S. When a key 712 is pushed down, the CPU 205 determines the completion of the setting about the casing-in bookbinding so as to allow the liquid crystal display 4-250 to display the screen of FIG. 6A.

(Procedure of Bookbinding Setting—Second Inputting Method)

Then, a second inputting method will be described.

The second inputting method uses image data inputted from the computer terminal 233 as image data for a plurality of pages used in printing the sheets S.

Figure 9:
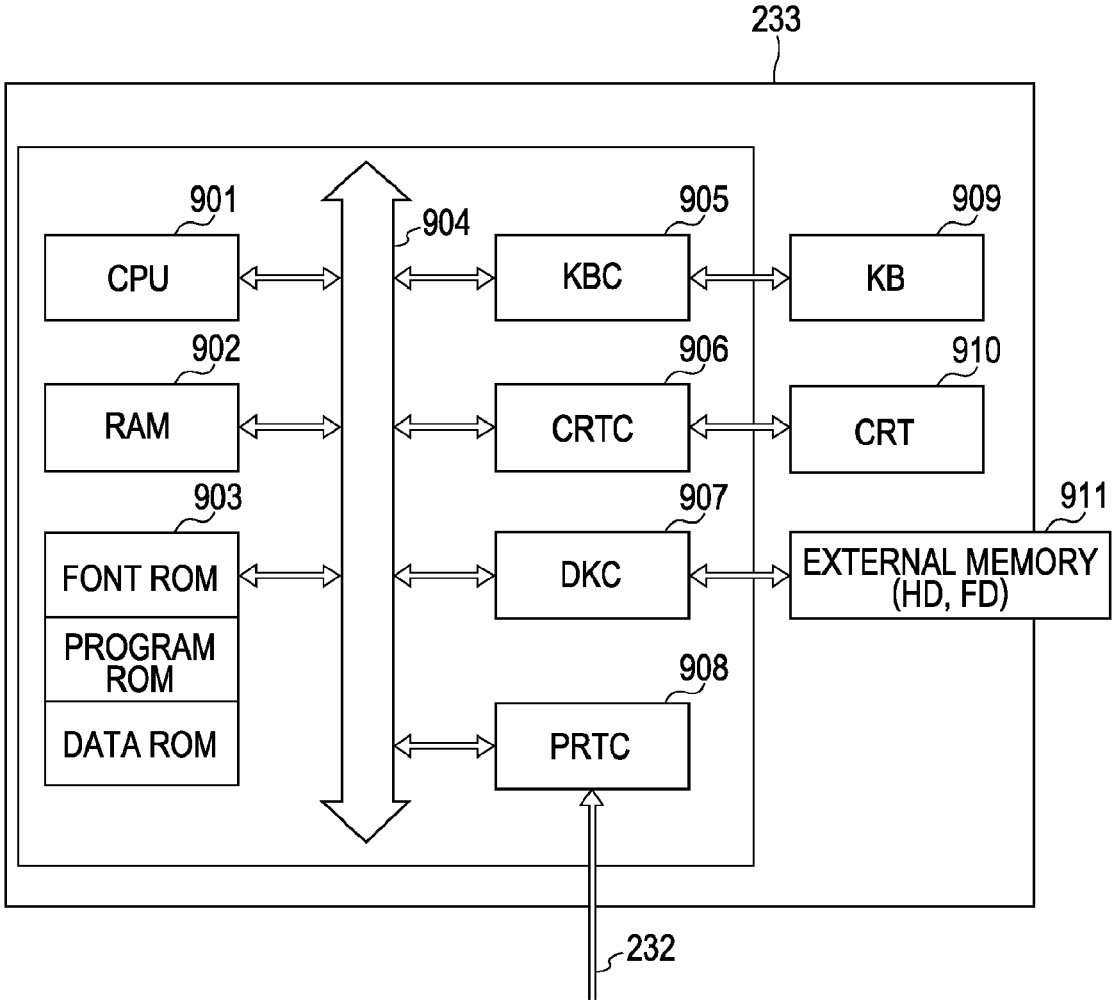
FIG. 9 is a drawing showing a configuration of a computer terminal according to an embodiment of the present invention.

FIG. 9 is a drawing of an exemplary configuration of the computer terminal 233.

Referring to FIG. 9, the computer terminal 233 includes a CPU 901 executing processing of mixed documents including graphic forms, images, and tables (including spreadsheet tables) on the basis of a document processing program stored in a programming ROM of a ROM 903 or an external memory 911. The CPU 901 controls each bus device connected to a system bus 904 correctively. In the programming ROM of the ROM 903 or the external memory 911, an operating system program (referred to as an OS below), which is a control program of the CPU 901, and a printer driver (mentioned below) are stored. In a font ROM of the ROM 903 or the external memory 911, font data used during the document processing are stored. In a data ROM of the ROM 903 or the external memory 911, various data used during the document processing are stored. An RAM 902 functions as a main memory and a work area of the CPU 901.

A keyboard controller (KBC) 905 controls the key entry from a key board 909 or a pointing device (not shown). A CRT controller (CRTC) 906 controls the displaying of a CRT display (CRT) 910. A disk controller (DKC) 907 controls the access to the external memory 911 such as a hard disk (HD) and a floppy™ disk (FD). In the external memory 911, a boot program, various applications, a printer-control command producing program (referred to as a printer driver below) are stored. A printer controller (PRTC) 908 is connected to the printing apparatus 105 via the network 232 so as to control the communication with the printing apparatus 105.

Figure 10:
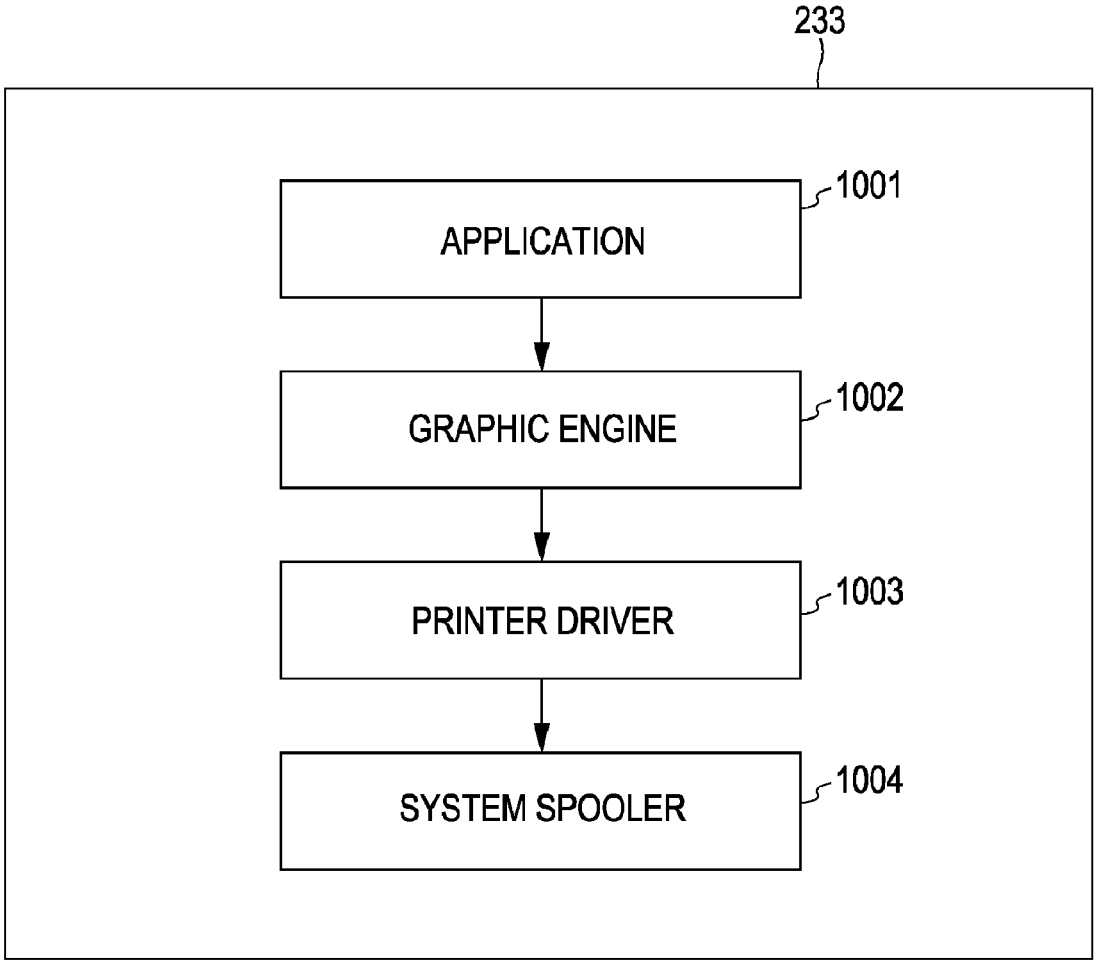
FIG. 10 is a drawing of a software configuration of a computer terminal according to an embodiment of the present invention.

FIG. 10 is a software configuration diagram of the computer terminal 233. An application 1001, a graphic engine 1002, a printer driver 1003, and a system spooler 1004 exist as software programs stored in the external memory 911.

The application 1001 stored in the external memory 911 is loaded in the RAM 902 for execution. When the printing job is transmitted to the printing apparatus 105 from the application 1001, the printing (outputting) is performed using the graphic engine 1002 that is executably loaded into the RAM 902.

The data outputted from the graphic engine 1002 is transmitted to the printer driver 1003. The printer driver 1003 is loaded into an RAM 902 from the external memory 911 and executed by the CPU 901. Then, the printer driver 1003 converts the data transmitted from the graphic engine 1002 into a control command which can be interpreted by the printing apparatus 105 (a PDL command, for example). The control command is to be outputted to the printing apparatus 105 via the system spooler 1004 loaded into the RAM 902 and the network 232. This control command will be referred to as a printing job.

In order to produce the printing job by the printer driver 1003, printing processing conditions in the printing apparatus 105 (the kind of the sheet for printing and the double-sided or one-sided printing, etc.) have to be established. These are set from a window generally provided by the printer driver 1003 (the menu displayed on the CRT 910). Then, the printer driver 1003 adds the contents set by an operator of the computer terminal 233 to the printing job via the window as the printing processing conditions.

Figure 11:
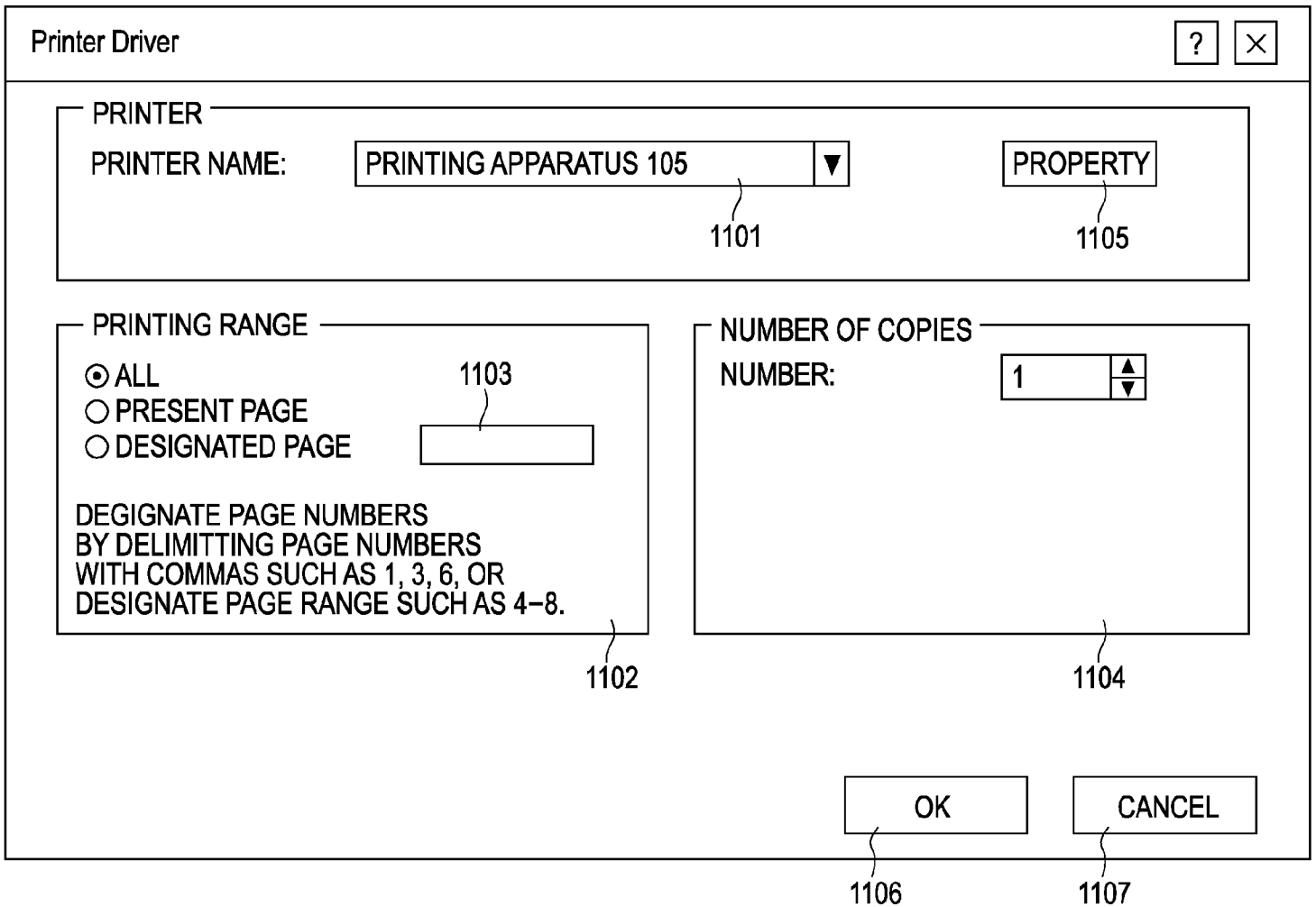
FIG. 11 is a drawing of a display screen for setting printing conditions by a printer driver according to an embodiment of the present invention.

FIG. 11 is a drawing of a window for setting the printing processing conditions by the printer driver 1003 installed into the computer terminal 233.

During producing document by the application 1001, the computer terminal 233 allows the CRT 910 to display the setting screen of FIG. 11 by activating the printer driver 1003.

Referring to the setting screen of FIG. 11, an operator (worker) of the computer terminal 233 operates a printer-name selection box 1101 using a pointing device (not shown). By this operation, the printing apparatus 105 or another printing apparatus is selected as a target of the printing job transmitted by the computer terminal 233. In FIG. 11, the computer terminal 233 selects the printing apparatus 105. The operator of the computer terminal 233 also operates a printing-range selection box 1102 using the pointing device. Thereby, a desired page among documents produced by the application 1001 is determined as a printing range to be printed by the printing apparatus 105. When the operator selects "all", the printer driver 1003 is to print the entire documents produced by the application 1001. When the operator selects "present page", the printer driver 1003 is to print the page presently displayed on the CRT 910 among a plurality of document pages produced by the application 1001. When the operator selects "designated pages", the printer driver 1003 is to print the pages inputted in an edit box 1103 among a plurality of document pages produced by the application 1001. Also, the printer driver 1003 is to print the number of copies inputted in a printing-copy number setting box 1104 by the operator.

Then, when completing the setting of printing processing conditions of the printing job to be transmitted to the printing apparatus 105, the operator of the computer terminal 233 pushes an OK button 1106 down. Thereby, the printer driver 1003 starts producing the printing job. In addition, when stopping the producing the printing job, the operator of the computer terminal 233 pushes a cancel button 1107 down.

Figure 12:
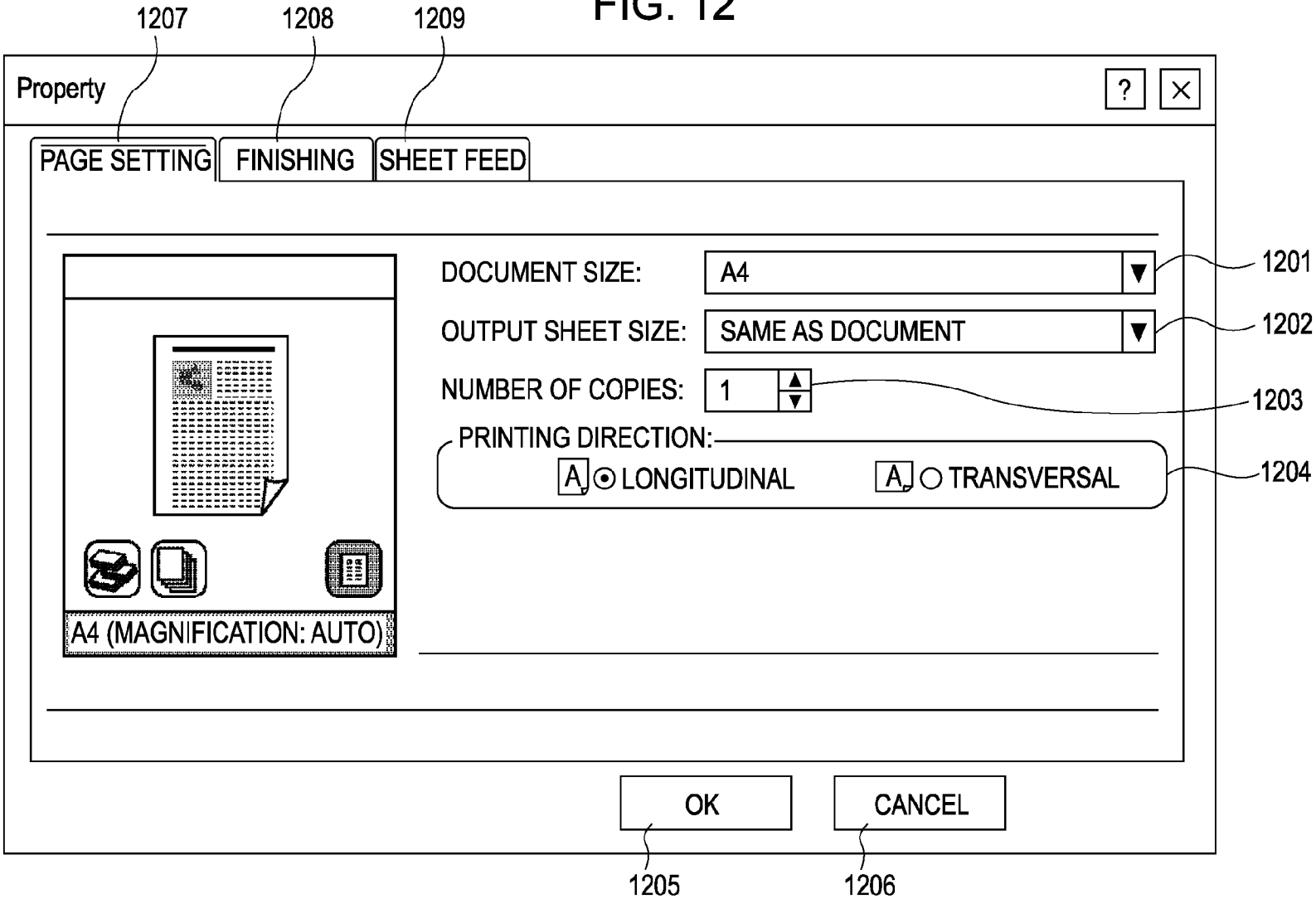
FIG. 12 is a drawing of a screen displayed when a property button is pushed down in a property setting screen of the printer driver according to an embodiment of the present invention.

FIG. 12 is a drawing of a screen displayed when a property button 1105 is pushed down in a printer-driver property setting screen of FIG. 11. In addition, FIG. 12 illustrates a screen displayed when a page setting tab is selected.

The operator of the computer terminal 233 operates a document-size selection box 1201 using the pointing device (not shown). By this operation, the printer driver 1003 selects the document size of each page of the document complied by the application 1001. The size of the document complied by the application 1001 has been generally designated so that this size is automatically selected (A4, in FIG. 12). When the operator selects "same as document size" in an output sheet-size selection box 1202, the printer driver 1003 selects "A4 size" as a sheet size used in printing (outputting) by the printing apparatus 105. In addition, the operator can also select a desired sheet size, such as "A3 size" and "B5 size", other than "same as document size". In this case, however, the size different from the document size is selected, so that the printer driver 1003 produces the printing job after changing the magnification. Also, the printer driver 1003 sets the number of copies in the printing job in accordance with that inputted by the operator in a copy number selection box 1203. The printer driver 1003 inputs the printing direction selected by the operator in a printing direction designation box 1204.

When an OK button 1205 is selected by the operator, the selections inputted in the document-size selection box 1201, the output sheet-size selection box 1202, the copy number selection box 1203, and the printing direction designation box 1204 are confirmed. On the other hand, when the operator selects a cancel button 1206, the selections inputted in the boxes 1201 to 1204 are not confirmed and returned to initial settings established in advance.

Figure 13:
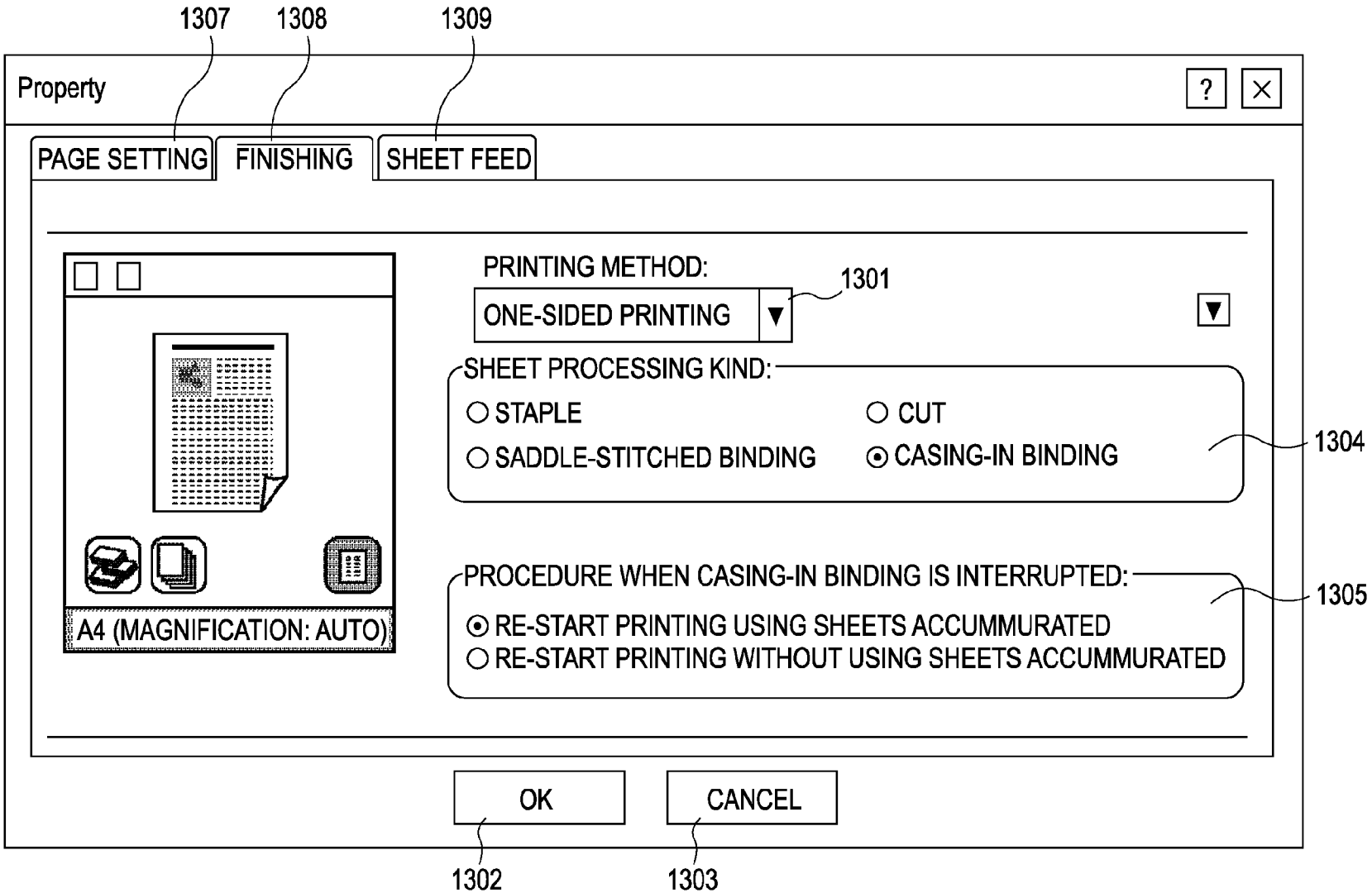
FIG. 13 is a drawing of a screen displayed when a finish tab is selected in the property setting screen of the printer driver according to an embodiment of the present invention.

FIG. 13 is a screen displayed when a finishing tab 1208 is selected in a property setting screen of the printer driver 1003 shown in FIG. 12.

The operator of the computer terminal 233 operates a printing method selection box 1301 using the pointing device (not shown). By this operation, the printer driver 1003 selects the printing method (one of the printing processing conditions) when the printing job is executed in the printing apparatus 105. The printing method includes "one-sided printing" printing only one side of the sheet and "double-sided printing" printing both sides of the sheet.

The operator of the computer terminal 233 also operates a sheet processing selection box 1304 using the pointing device (not shown). By this operation, the printer driver 1003 selects the kind of the sheet processing to be performed on the sheet which has been printed in the printing apparatus 105. The kind of the sheet processing includes staple processing, cutting, saddle-stitched binding, and casing-in binding. The stapling is the processing executed by the saddle-stitched bookbinding apparatus 102, and the stapling is performed on edges of a plurality of the sheets which have been printed in the printing apparatus 105. The saddle stitching is processing executed by the saddle-stitched bookbinding apparatus 102, and the stapling is performed on the center portions of a plurality of the sheets which have been printed in the printing apparatus 105 as well as the sheets are folded at the center portions. The cutting is processing executed by the paper cutter 101, and the cutting is performed on end portions of a plurality of the sheets which have been printed in the printing apparatus 105. The casing-in binding is processing executed by the casing-in bookbinding apparatus 103, and a plurality of the sheets S which have been printed in the printing apparatus 105 are wrapped around the cover sheet and bonded thereto so as to obtain the bound book.

The operator of the computer terminal 233 also operates a box 1305 using the pointing device (not shown). By this operation, when the interruption is generated in the printing job of the casing-in binding designated as the sheet processing, the printer driver 1003 selects the way how to re-start the processing. The re-starting method of the printing processing includes a method using sheets already accommodated on the accumulating tray 42 and a method without using the accommodated sheets. When the former method is selected, the economy due to use of the already printed sheets takes the precedence. On the other hand, if the latter method is selected, the removal of defective bound books due to no use of the already printed sheets takes the priority.

Then, when the operator selects an OK button 1302, the selections inputted in the printing method selection box 1301 and the sheet processing selection box 1304 are confirmed. On the other hand, if the operator selects a cancel button 1303, the selections inputted in the printing method selection box 1301 and the sheet processing selection box 1304 are not confirmed and returned to initial settings established in advance.

(Executing Procedure of Bookbinding—One-Sided Printing)

Figure 14:
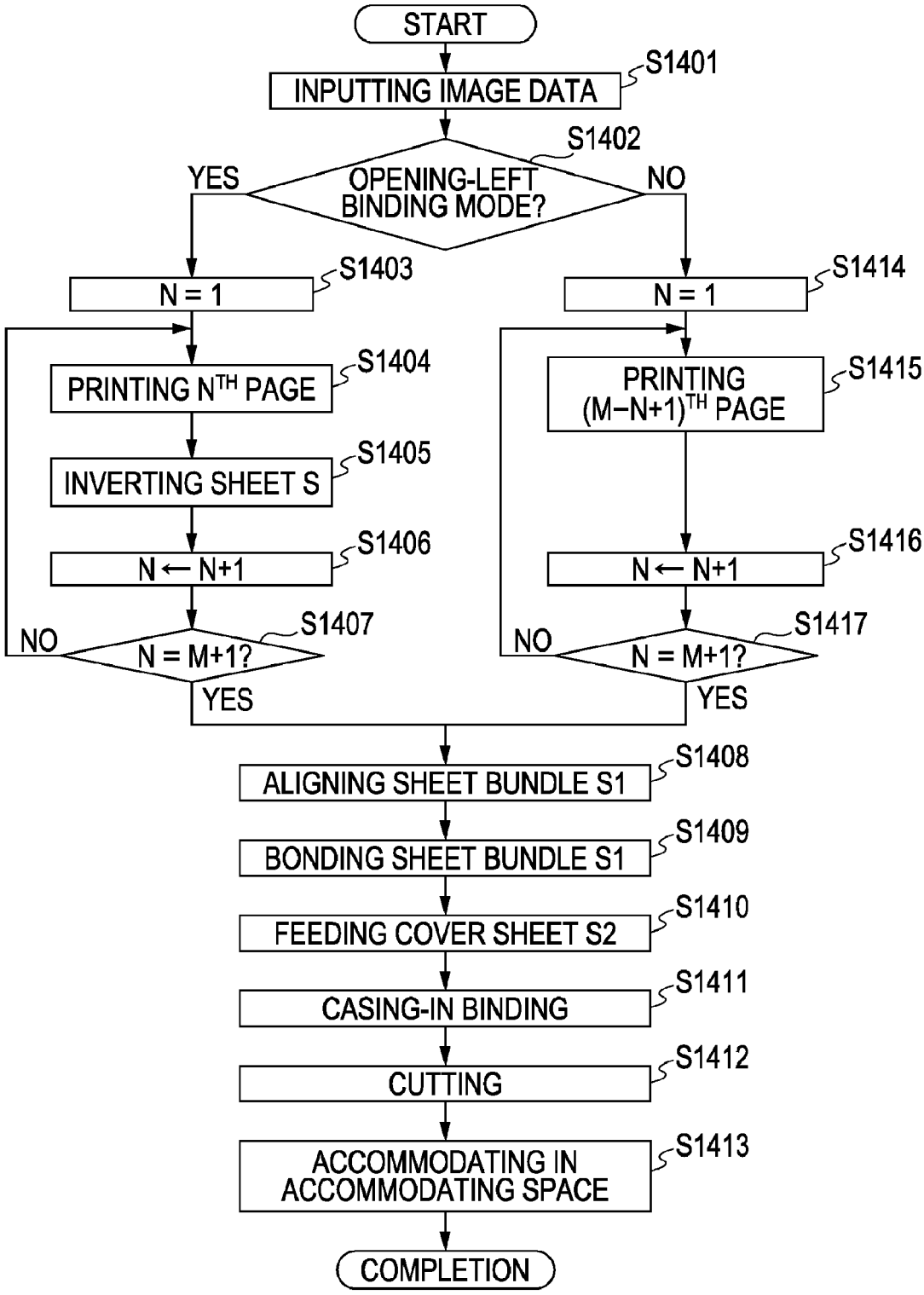
FIG. 14 is a flowchart of a bookbinding process according to an embodiment of the present invention.

Next, the flow of the bookbinding according to the first embodiment will be described with reference to FIG. 14. Each step in the flowchart of FIG. 14 is executed by the CPU 205 that reads out the program stored in the hard disk 209 to the RAM 208. The casing-in binding executed by pushing the casing-in bookbinding key 603 on the screen of FIG. 6C is described hereinafter. FIG. 14 shows the operations when the printing only one side of the sheet S is set in FIG. 7D.

At Step S1401, the CPU 205 executes the inputting image data for a plurality of pages. The inputting processing may employ any one of the above-mentioned two methods. When the first method, which inputs image data from the scanner unit 201, is employed, when a start key 4-241 is pushed down, the image data for a plurality of pages are inputted by reading images on documents placed on the document feed unit 250 so as to output them to the printer unit 203. On the other hand, when the second method using the printing job (image data) received from the computer terminal 233 is employed, the external I/F 202 reads out the image data included in the printing job as a control code by receiving the printing job. Then, the memory controller 206 outputs the read out printing job to the printer unit 203 so that the image data for a plurality of pages are inputted.

At Step S1402, the CPU 205 determines that the binding mode set by the operator in FIG. 7C is whether the opening right binding mode or the opening left binding mode. If it is the opening left binding mode, the process proceeds to Step S1403, and if it is the opening right binding mode, the process proceeds to Step S1414.

Steps S1403 to S1407 are printing processes in that the printing job composed of the image data for M pages is performed on a first page, a second, . . . an $M-1^{th}$, and an $M^{th}$ page. Whereas, Steps S1414 to S1417 are printing processes in that the printing is performed on an $M^{th}$ page, an $M-1^{th}$, . . . a second, and a first page in the order reverse to the Steps S1403 to S1407.

At Step S1403, the CPU 205 sets the initial value "1" as a page identification information N for controlling the printing order of the image data for a plurality of pages. The page identification information N is stored in the RAM 208 and is the information readable and writable by the CPU 205.

At Step S1404, the CPU 205 allows the printer unit 203 to execute the printing on an $N^{th}$ page, and the sheet S is conveyed to the stacker 104 after the sheet S is inverted at Step S1405. The reason for the inversion is that the sheet S with its printed top surface (face up state) is accumulated on the accumulating tray 42 in a state downwardly directing the printed surface (face down state). Then, the CPU 205 allows a conveying unit (not shown) within the stacker 104 to convey the sheet S to the casing-in bookbinding apparatus 103. Also, the CPU 205 allows the casing-in bookbinding apparatus 103 to convey the sheet S conveyed from the stacker 104 to the accumulating tray 42.

At Step S1406, the CPU 205 adds "1" to the page identification information N and the process proceeds to Step S1407. At Step S1407, the CPU 205 determines whether the page identification information N becomes M+1, and if N=M+1, the process proceeds to Step S1408; if not, the process returns to Step S1404. The M herein is the number of pages of the printing job, and if the printing job is the image data for 10 pages, for example, "10" is established. In the above-mentioned second method, since the printing job is stored in the hard disk 209 in advance so that the number of pages is determined, this page number is set as M. On the other hand, in the first method, the number of pages is not determined in advance. Then, at Step S1407, the CPU 205 determines the presence of the document to be sequentially read out by detecting it with a document detecting sensor (not shown) provided in the scanner unit 201. Specifically, if the CPU 205 determines the absence of the document to be sequentially read out, the process proceeds to Step S1408; if not, the process returns to Step S1404.

The CPU 205 forms the sheet bundle S by repeating the Steps S1404 to S1407 so as to accumulate a plurality of sheets S on the accumulating tray 42.

Steps to be executed when the CPU 205 determines the mode to be the right opening bookbinding mode will now be described.

At Step S1414, the CPU 205 sets the initial value "1" as the page identification information N for controlling the printing order of the image data for a plurality of pages.

At Step S1415, the CPU 205 allows the printer unit 203 to execute the printing on an $(M-N+1)^{th}$ page. The reason for the $(M-N+1)^{th}$ page is that when the printing job of M pages is performed, the printing starts from the $M^{th}$ page, which is the last page. In the right opening bookbinding mode, the sheet S is not inverted differently from the left opening bookbinding mode. This is because the printed sheets S are accumulated on the accumulating tray 42 in the face-up state (the state upwardly directing the printed surface). The CPU 205 herein allows the conveying unit (not shown) within the stacker 104 to convey the sheet S to the casing-in bookbinding apparatus 103. Also, the CPU 205 allows the casing-in bookbinding apparatus 103 to convey the sheet S conveyed from the stacker 104 to the accumulating tray 42.

At Step S1416, the CPU 205 increases the page identification information N and the process proceeds to Step S1417. At Step S1417, the CPU 205 determines whether the page identification information N becomes (M+1), and if N=M+1, the process proceeds to Step S1408; if not, the process returns to Step S1415. In the first method, as mentioned above, the number of documents read by the scanner unit 201 is not determined until the entire documents are read out. Then, at Step S1417, the CPU 205 determines the presence of the document to be sequentially read out by detecting it with the document detecting sensor (not shown). Specifically, if the CPU 205 determines the absence of the document to be sequentially read out, the process proceeds to Step S1408; if not, the process returns to Step S1415.

The CPU 205 forms the sheet bundle S1 by repeating the Steps S1415 to S1417 so as to accumulate a plurality of sheets S on the accumulating tray 42.

The bookbinding using the sheet bundles S1 formed on the accumulating tray 42 by repeating the Steps S1404 to S1407 and the Steps S1414 to S1417 will be described below. The specific operations using the casing-in bookbinding apparatus 103 are the same as those described with reference to FIG. 8.

The CPU 205 aligns the sheet bundle S at Steps S1408, and aligns the sheet bundle S with the cover sheet S2 at Steps S1409 by applying an adhesive on an end of the sheet bundle S1. On the other hand, the CPU 205 feeds the cover sheet S2 stacked on the cover sheet accumulating tray. In FIG. 14, the cover sheet S2 is fed (S1410) after the adhesive is applied (S1409); alternatively, the cover sheet S2 may be fed before the adhesive application.

The CPU 205 executes the bookbinding by bonding one end of the sheet bundle S1 on the back portion of the cover sheet S2 (back portion of the backbone region 1002) at Steps S1411. Then, the CPU 205 performs cutting on the sheet bundle S1 having the cover sheet S2 bonded thereto at Steps S1412 and accumulates the sheet bundle S1 on the accommodation unit 34 at Steps S1413.

(Executing Procedure of Bookbinding—Double-Sided Printing)

Figure 15:
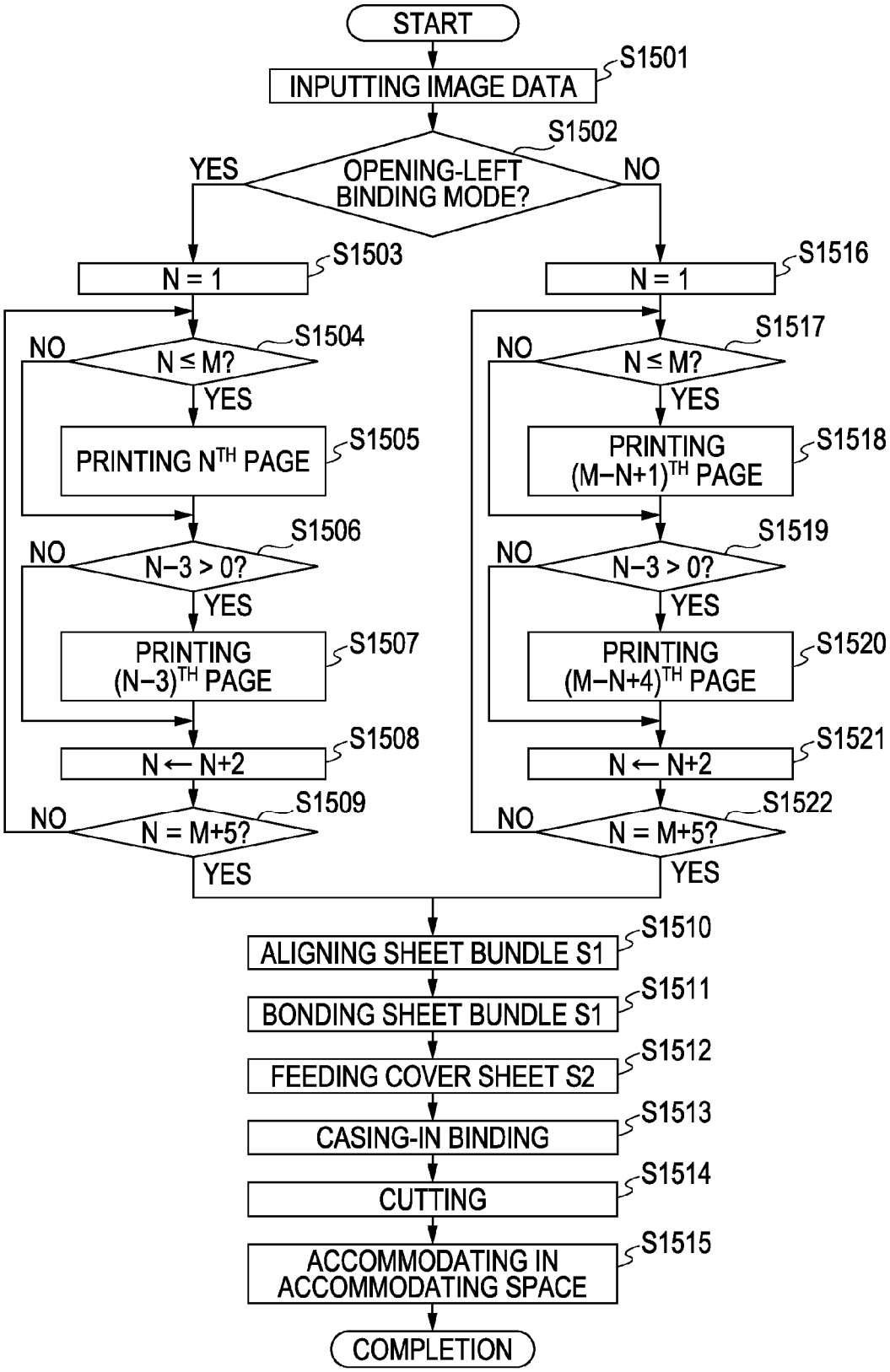
FIG. 15 is a flowchart of the bookbinding process according to an embodiment of the present invention.

The process of the bookbinding according to the first embodiment will now be described with reference to FIG. 15. The casing-in bookbinding will be described hereinafter which is executed when the casing-in bookbinding key 603 on the screen of FIG. 6C is pushed. FIG. 15 shows the operations when the double-sided printing of the sheet S is set in FIG. 7D.

Since the Steps S1501 and S1502 of FIG. 15 are the same as the Steps S1401 and S1402 of FIG. 14, the description is omitted. Also, the Steps S1510 to S1515 of FIG. 15 are the same as the Steps S1408 to S1413 of FIG. 14, so that the description is omitted.

The Steps S1503 to S1509 below are the process of printing the printing job of image data for M pages from a first page, . . . to the $M^{th}$ page. Whereas, the Steps S1515 to S1521 are the process printing the job from the $M^{th}$ page, . . . to the first page in the order reverse to that of the Steps S1503 to S1509. Since the sheet S is double-sided printed in FIG. 15, the process is different from that printing the job in the order of from a first page, a second page, a third page . . . .

At Step S1503, the CPU 205 sets the initial value "1" as the page identification information N.

At Step S1504, the CPU 205 determines whether the page identification information N is M or less, and if N≦M, the process proceeds to Step S1505; if not, the process proceeds to Step S1506.

At Step S1505, the CPU 205 allows the cassette selected by pushing down the key 705 of FIG. 7B to feed the sheet S so as to print the images of the $N^{th}$ page on the sheet.

At Step S1506, the CPU 205 determines whether "N−3" is larger than "0", if it is larger, the process proceeds to Step S1507; if not, the process proceeds to Step S1508. At Step S1507, the CPU 205 executes printing $(N-3)^{th}$ page images on the sheet S conveyed from the re-feed sheet conveying path 332. Numeral "3" herein designates the number of sheets retainable in the printing apparatus 105. Upon double-sided printing, the printing apparatus 105 executes printing on three sheets continuously fed from the cassette. Thereafter, the printing apparatus 105 alternately repeats the printing images on the sheet S fed from the re-feed sheet conveying path 332 and the printing odd pages images on the sheet S fed from the cassette. By the repeated printing, both sides of the sheet S are printed.

At Step S1508, the CPU 205 adds "2" to "N" and the process proceeds to Step S1509. At Step S1509, the CPU 205 determines whether the page identification information N becomes M+5, and if N=M+5, the process proceeds to Step S1510; if not, the process returns to Step S1504.

The printing order in the printing, which the CPU 205 allows the printer unit 203 to execute, will be described by assuming that the printing job is composed of image data for 10 pages and the cassette 311 is selected in FIG. 7B.

First, the CPU 205 allows the cassette 311 to feed three sheets S, and first page images, third page images, and fifth page images are printed on the three sheets, respectively. The CPU 205 also conveys the three sheets, respectively having the first page images, third page images, and fifth page images printed thereon, to the re-feed sheet conveying path 332. The sheets S conveyed from the re-feed sheet conveying path 332 are conveyed to the transfer unit 325 with the downward directed printed surface.

Then, the sheet S having the first page images printed thereon is conveyed to the transfer unit 325 by the CPU 205, and the second page images are printed on the opposite side. Thereafter, the sheet S having both the first page images and second page images printed thereon is conveyed to the stacker 104 by the CPU 205. Continuously, the seventh page images are printed on the sheet S fed from the cassette 311 by the CPU 205. Then, the sheet S having the third page images printed thereon is conveyed to the transfer unit 325 by the CPU 205, so that the fourth page images are printed on the opposite side. Then, the ninth page images are printed on the sheet S fed from the cassette 311 by the CPU 205. Subsequently, the CPU 205 continuously conveys the sheets, respectively having the fifth page images, seventh page images, and ninth page images printed thereon, to the transfer unit 325 from the re-feed sheet conveying path 332, so that the sixth page images, eighth page images, and tenth page images are printed on these sheets, respectively.

As described above, the printing order of image data for a plurality of pages is a page order of 1-3-5-2-7-4-9-6-8-10.

The process executed when the CPU 205 determines the mode to be the right opening bookbinding mode at Step S1502 will be described.

At Step S1516, the CPU 205 sets the initial value "1" as the page identification information N.

At Step S1517, the CPU 205 determines whether the page identification information N is M or less, and if N≦M, the process proceeds to Step S1518; if not, the process proceeds to Step S1519.

At Step S1518, the CPU 205 allows the cassette selected by pushing down the key 705 of FIG. 7B to feed the sheet S so as to print the images of the $(M-N+1)^{th}$ page on the sheet.

At Step S1519, the CPU 205 determines whether "N−3" is larger than "0", if it is larger, the process proceeds to Step S1520; if not, the process proceeds to Step S1521. At Step S1520, the CPU 205 executes printing $(M-N+4)^{th}$ page images on the sheet S conveyed from the re-feed sheet conveying path 332. Thereafter, the printing apparatus 105 alternately repeats the printing images on the sheet S fed from the re-feed sheet conveying path 332 and the printing images on the sheet S fed from the cassette. By the repeated printing, both sides of the sheet S are printed.

At Step S1521, the CPU 205 adds "2" to N and the process proceeds to Step S1522. At Step S1522, the CPU 205 determines whether the page identification information N becomes (M+5), and if N=M+5, the process proceeds to Step S1510; if not, the process returns to Step S1517.

The printing order in the printing, which the CPU 205 allows the printer unit 203 to execute, will be described by assuming that the printing job is composed of image data for 10 pages and the cassette 311 is selected in FIG. 7B.

First, the CPU 205 allows the cassette 311 to feed three sheets S, and tenth page images, eighth page images, and sixth page images are printed on the three sheets, respectively. The CPU 205 also conveys the three sheets, respectively having the tenth page images, the eighth page images, and the sixth page images printed thereon, to the re-feed sheet conveying path 332.

Then, the sheet S having the tenth page images printed thereon is conveyed to the transfer unit 325 by the CPU 205, and the ninth page images are printed on the opposite side. Thereafter, the sheet S having both the tenth page images and the ninth page images printed thereon is conveyed to the stacker 104 by the CPU 205. Continuously, the fourth page images are printed on the sheet S fed from the cassette 311 by the CPU 205. Then, the sheet S having the eighth page images printed thereon is conveyed to the transfer unit 325 by the CPU 205, so that the seventh page images are printed on the opposite side. Then, the second page images are printed on the sheet S fed from the cassette 311 by the CPU 205. Subsequently, the CPU 205 continuously conveys the sheets, respectively having the sixth page images, fourth page images, and second page images printed thereon, to the transfer unit 325 from the re-feed sheet conveying path 332, so that the fifth page images, third page images, and first page images are printed on these sheets, respectively.

As described above, the printing order of image data for a plurality of pages is 10-8-6-9-4-7-2-5-3-1, which is a page order reverse to that of the left opening bookbinding.

(Restart Printing During Interruption)

The restart printing when the printing is interrupted will now be described.

Figure 16:
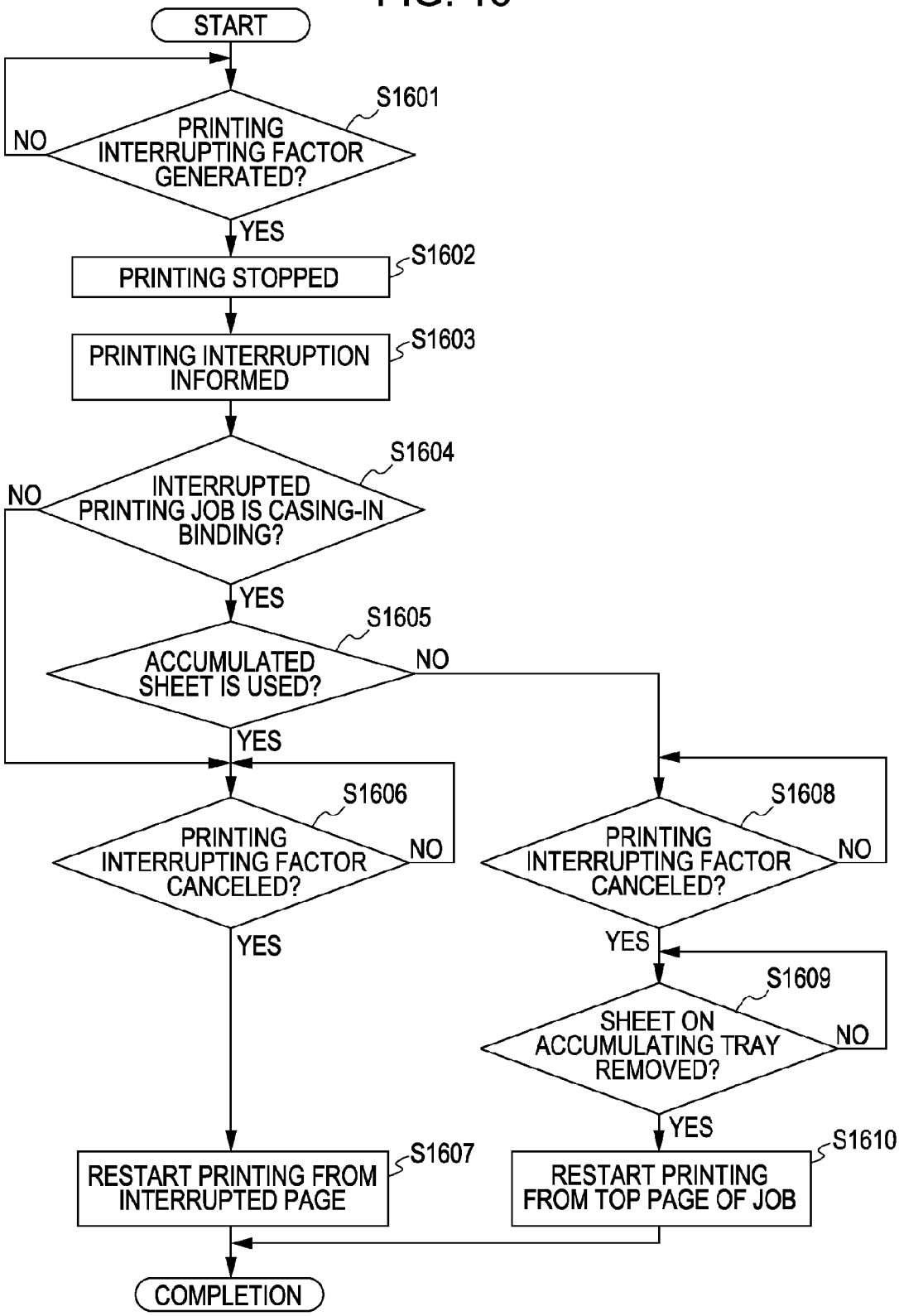
FIG. 16 is a flowchart showing a printing restart process when the printing is interrupted according to an embodiment of the present invention.

FIG. 16 is a flowchart of the restart printing process when the printing is interrupted.

Each step in the flowchart of FIG. 16 is executed by the CPU 205 of the printing apparatus 105 that reads out the program stored in the hard disk 209 to the RAM 208. Each step in the flowchart of FIG. 16 is also executed in parallel with those of FIGS. 14 and 15. No interrupting factor generated during executing printing job by the printing apparatus 105 and during bookbinding by the casing-in bookbinding apparatus 103 has been shown in FIGS. 14 and 15. However, during the printing and the casing-in bookbinding (correctively referred to as the printing processing below), the interrupting factors such as sheet conveying errors (jamming) may be generated in practice. FIG. 16 shows that the CPU 205 determines whether the printing interrupting factor is generated during the printing, and the bookbinding system 2000 operates so as to restart the printing.

At Step S1601, the CPU 205 determines whether the interrupting factor is generated during the printing processing executed based on the printing job. The interrupting factor herein designates defective operations in the bookbinding system 2000, such as conveying errors of the sheet S in the conveying paths of the printing apparatus 105 and the stacker 104. In order to determine the generation of the interrupting factor, the CPU 205 determines whether the conveying error is generated, using a sensor (not shown) provided in the conveying paths 331 to 335 of the printing apparatus 105 (or the conveying path of the stacker 104). For example, when the sensor on the conveying path 331 continues to detect a sheet for a predetermined time, the CPU 205 determines that it is the conveying error. Also, in order to determine the generation of the interrupting factor, the CPU 205 determines the defective operation of the bookbinding system 2000. For example, when receiving the device malfunction as a status from the CPU of the casing-in bookbinding apparatus 103, the CPU 205 determines that the defective operation is generated in the casing-in bookbinding apparatus 103.

At Step S1602, the CPU 205 stops the printing processing by the bookbinding system 2000. For example, when the printing job is the casing-in bookbinding job, the CPU 205 stops the entire bookbinding system 2000 including the casing-in bookbinding apparatus 103.

At Step S1603, the CPU 205 informs an operator of the bookbinding system 2000 about the printing interruption via the display screen (LED, etc.) of the operation unit 204. Upon this information, it is desirable that the display screen of the operation unit 204 clearly specify the interruption factor. For example, when the conveying defect (jamming) is generated in the conveying path 331 of the printing apparatus 105, it is desirable to inform this fact along with the removing method of the sheet.

At Step S1604, the CPU 205 determines whether the interrupted printing job is the casing-in bookbinding job on the basis of the printing processing condition information included in the printing job. For example, when the computer terminal 233 establishes the casing-in bookbinding as a printing processing condition by the printer driver 1003, the printing job includes the casing-in bookbinding information as the printing processing condition information. When the printing processing condition information includes the casing-in bookbinding, the process proceeds to Step S1605; if not, the process proceeds to Step S1606.

At Step S1605, the CPU 205 determines whether the accumulated sheet is used for restarting printing when the interrupted printing job is the casing-in bookbinding job. The computer terminal 233 adds the disposal method when the casing-in bookbinding is interrupted upon executing the printing job by the printer driver 1003 to the printing processing condition information. When the printing job includes the information that the accumulated sheet is used, the process proceeds to Step S1606; if not, the process proceeds to Step S1608.

At Steps S1606 and S1608, the CPU 205 determines whether the interrupting factor of the printing has been cancelled or not. For example, when the printing is interrupted due to the conveying sheet defect generated in the conveying path 331 of the printing apparatus 105, it is determined by the sensor provided on the conveying path 331. When the sheet S is not detected in the conveying path 331, the CPU 205 determines that the interrupting factor is cancelled due to the removal of the defective sheet. For example, when the printing is interrupted due to a malfunction generated in the casing-in bookbinding apparatus 103, the status of the casing-in bookbinding apparatus 103 is to be determined. When receiving a status signal indicating that the apparatus restores the normal state from the CPU of the casing-in bookbinding apparatus 103, the CPU 205 determines the canceling of the interrupting factor. When the CPU 205 determines the canceling of the interrupting factor at Step S1606, the process proceeds to Step S1607; when the CPU 205 determines the canceling of the interrupting factor at Step S1608, the process proceeds to Step S1607, the process proceeds to Step S1609.

The operations during the restarting printing will now be described.

Step S1607 is the process executed when the interrupted printing job is not the casing-in bookbinding job or it is the casing-in bookbinding job and the printing is to be restarted using the sheet bundle S1 accumulated on the accumulating tray 42. Steps S1609 and S1610 are the processes executed when the interrupted printing job is the casing-in bookbinding job and the printing is to be restarted without using the sheet bundle S1 accumulated on the accumulating tray 42.

First, the operations executed when the printing is restarted using the sheet bundle S1 accumulated on the accumulating tray 42 will be described.

At Step S1607, the CPU 205 restarts the printing from the page when the printing is interrupted. The page when the printing is interrupted means herein the page to be sequentially stacked onto the sheet bundles S1 accumulated on the accumulating tray 42. When the printing is interrupted, the sheet S already printed by the printing apparatus 105 also exists in the conveying path of the bookbinding system 2000. When all the sheets existing in the conveying path are removed during the printing interruption, the CPU 205 determines the canceling of the interrupting factor at Step S1606. The page when the printing is interrupted may also have another form. For example, it may also be a page, which exists in the printing apparatus 105 when the printing is interrupted, to be discharged onto the stacker 104 in the next. In this case, the sheet already discharged from the printing apparatus 105 is to be conveyed to the accumulating tray 42 after the printing is restarted. Then, the CPU 205 determines the canceling of the interrupting factor when all the sheets existing in the conveying path of the printing apparatus 105 are removed.

The operations executed when the printing is restarted without using the sheet bundle S1 accumulated on the accumulating tray 42 will now be described.

At Step S1609, the CPU 205 determines whether the sheet bundle S already stacked onto the accumulating tray 42 is removed by an operator of the bookbinding system 2000. When a sensor (not shown) provided in the accumulating tray 42 does not output the information designating the existing of the sheet S, the CPU 205 determines the removal of the sheet bundle S, and the process proceeds to Step S1610. When the printing is interrupted, the sheet S already printed by the printing apparatus 105 also exists in the conveying path of the bookbinding system 2000. When all the sheets existing in the conveying path are removed during the printing interruption, the CPU 205 determines the canceling of the interrupting factor at Step S1608.

At Step S1610, the CPU 205 restarts the interrupted printing job from the top page.

As described above, according to the embodiment, when an interrupting factor is generated for interrupting the printing job, it can be selected whether the economy due to use of the sheets already stacked on the accumulating tray 42 takes the precedence, or the removal of defective bound books due to no use of these sheets takes the priority.

When an interrupting factor is generated for interrupting the printing job, it can be determined via the printer driver 1003 whether the sheets already stacked on the accumulating tray 42 are used or not. Thereby, when an operator attaches importance on the economy, the sheet bundles S1 stacked on the accumulating tray 42 during printing interruption can be used. On the other hand, when the operator dislikes defective bound books, the operator can begin again the printing without using the sheet bundles S1 stacked on the accumulating tray 42.

In the description above, the method for restarting the printing during the interruption of the casing-in bookbinding is established via the printer driver 1003 of the computer terminal 233; alternatively, it may have another form. For example, it may be established (received) via the operation unit 204 of the printing apparatus 105. In this case, despite the external I/F 202 receives any printing job from the computer terminal 233, the printing is always restarted by the method established via the operation unit 204.

Second Exemplary Embodiment

A second embodiment according to the present invention will be described below.

The second embodiment is a modification of the first embodiment and the operations according to this embodiment are the same as those in FIG. 16; however, the operation at Step S1605 of FIG. 16 is different from that of the first embodiment.

According to the first embodiment, at Step S1605 of FIG. 16, the selection between the use of the accumulated sheet bundle S and no use thereof is made based on the printing condition information included in the printing job or the information established via the operation unit 204; whereas, according to the second embodiment, the selection between the use of the accumulated sheet bundle S for forming a bound book and the no use thereof is made in accordance with the printing interrupting factor.

FIG. 17 is a table showing the printing interrupting factors and disposal methods corresponding to the factors. The CPU 205 determines whether the accumulated sheet bundle S1 is used or not with reference to the printing interrupting factor and the table of FIG. 17.

For example, when the CPU 205 determines the shortage of the developer contained in the developing unit 324 of the printing apparatus 105, the use of the accumulated sheet is decided. This is because of the large possibility of no sheet defect in the printed sheets stacked on the accumulating tray 42.

For example, when the CPU 205 determines the sheet defect in a conveying path of the printing apparatus 105 or a conveying path of the bookbinding system 2000 other than the printing apparatus 105, the no use of the accumulated sheet is decided. This is because of the large possibility of the sheet defect, such as damage and contamination, produced when the sheet conveying defect is generated. The selection between the use of the accumulated sheet bundle and the no use thereof may be switched in accordance whether the conveying defect is generated in the printing apparatus 105 or it is generated in a conveying path other than the printing apparatus 105. For example, when it is generated in the printing apparatus 105, the use of the accumulated sheet bundle is decided, while when it is generated in other than the printing apparatus 105, the no use is decided. This is because of the large possibility of the sheet damage and contamination produced when the sheet conveying defect is generated in other than the printing apparatus 105.

When the cassette of the printing apparatus 105 for use in the printing job runs short of stacked sheets (zero sheet, for example), the use of the accumulated sheet bundle is decided. This is because of the large possibility of no sheet defect in the printed sheets stacked on the accumulating tray 42.

When the printing job is interrupted by the instruction of an operator, the use of the accumulated sheet bundle is decided. This is because of the large possibility of no sheet defect in the printing apparatus 105 when the printing is interrupted by the instruction of the operator.

As described above, according to the second embodiment, when an interrupting factor is generated for interrupting the printing job, the selection between the use of the accumulated sheet bundle S1 and no use thereof is made in accordance with the interrupting factor. Thereby, the economy due to use of the sheets already stacked on the accumulating tray 42 and the removal of defective bound books due to no use of these sheets appropriately become compatible with each other in accordance with the interrupting factor.

Third Exemplary Embodiment

A third embodiment according to the present invention will be described below.

The third embodiment is a modification of the first embodiment and the operations according to this embodiment are the same as those in FIG. 16; however, the operation at Step S1605 of FIG. 16 is different from that of the first embodiment.

According to the first embodiment, at Step S1605 of FIG. 16, the selection between the use of the accumulated sheet bundle S1 and no use thereof is made based on the printing condition information included in the printing job or the information established via the operation unit 204; whereas, according to the third embodiment, the selection between the use of the accumulated sheet bundle S1 for forming a bound book and the no use thereof is made in accordance with the number of the sheet bundles S1 accumulated on the accumulating tray when the printing is interrupted.

FIG. 18 is a table showing the number of the sheet bundles S1 stacked on the accumulating tray 42 when the printing is interrupted and stored in the hard disk 209 of the printing apparatus 105 and disposal methods corresponding to the numbers. The CPU 205 determines whether the accumulated sheet bundle S1 is used or not with reference to the number of the sheet bundles S1 when the printing is interrupted and the table of FIG. 18.

Specifically, the CPU 205 counts the number of the sheet bundles S1 stacked on the accumulating tray 42 from the start of the printing based on the printing job to the interruption of the printing so as to store the counted number of the sheet bundles S in the hard disk 209. If this number of the sheet bundles S ranges from 1 to 100, the CPU 205 restarts the printing without using the accumulated the sheet bundles S1. This is because such a range of the number of the sheet bundles S1 does not so much deteriorate the economy. On the other hand, if the number of the sheet bundles S1 ranges from 101 to 200, the CPU 205 restarts the printing using the accumulated the sheet bundles S1. This is because such a range of the number of the sheet bundles S1 deteriorates the economy so much. In addition, the accumulating tray 42 of the casing-in bookbinding apparatus 103 can stack 200 sheets S thereon as long as the sheet is plain paper.

In FIG. 18, when the number of the sheet bundles S1 stacked on the accumulating tray 42 is less than 100, the sheet bundles S1 stacked on the accumulating tray 42 are not used, while when it is more than 100, the sheet bundles S1 stacked on the accumulating tray 42 are used. Whereas, in FIG. 19, the selection is allowed to an operator.

Figures 19, 20:
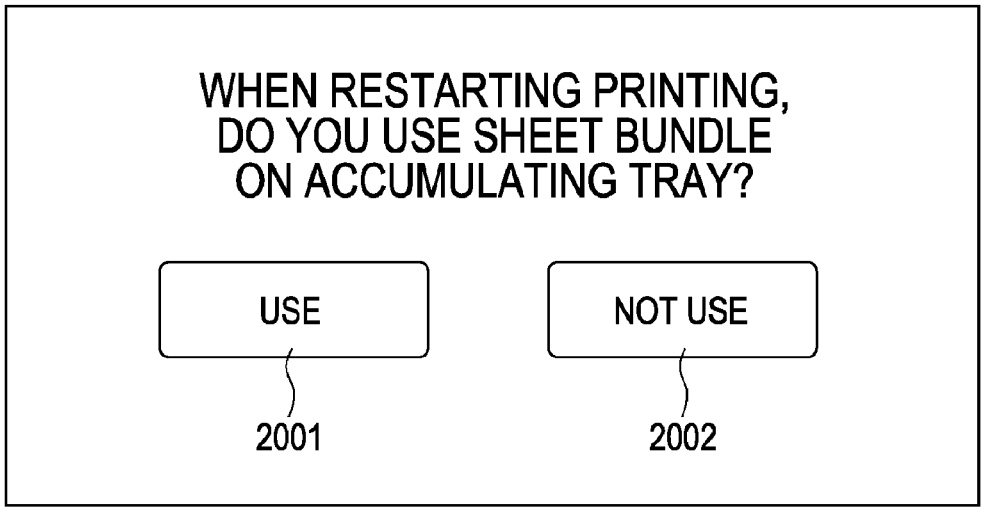
FIG. 19 is a table showing the number of sheets stacked on an accumulation tray during the printing interrupting and treating methods for the number according to an embodiment of the present invention.
FIG. 20 is a drawing showing a display screen for allowing a user to designate whether the sheets stacked on the accumulation tray are used or not according to an embodiment of the present invention.

In FIG. 19, if the counted number of sheets ranges from 1 to 100 when a printing interrupting factor is generated, the CPU 205 restarts the printing without using the sheet bundles S1 stacked on the accumulating tray 42. This is because such a range of the number of the sheets does not so much deteriorate the economy. On the other hand, if the number of the sheets ranges from 181 to 200, the CPU 205 restarts the printing using the accumulated the sheet bundles S1. This is because such a range of the number of the sheets deteriorates the economy so much.

Furthermore, if the counted number of sheets ranges from 101 to 180 when a printing interrupting factor is generated, the CPU 205 allows an operator of the bookbinding system 2000 to designate whether the sheet bundles S1 stacked on the accumulating tray 42 is used or the sheet bundle is not used, upon restarting the printing. Specifically, the CPU 205 allows the operation unit 204 to display the screen shown in FIG. 20 on its display screen. The operator inputs the information designating the restarting the printing using the sheet bundles S stacked on the accumulating tray 42 by pushing down a button 2001 on the screen of FIG. 20. On the other hand, the operator inputs the information designating the restarting the printing without using the sheet bundles S stacked on the accumulating tray 42 by pushing down a button 2002 on the screen of FIG. 20. When the former is selected, the CPU 205 restarts the printing from the page associated with the printing interrupting factor while when the latter is selected, the CPU 205 restarts the printing from the top page of the printing job.

In the description above, the accumulating tray 42 can stack 200 sheets thereon; alternatively, another form may be made. The printing apparatus 105 can employ a plurality of types of the sheet S. The type of the sheet includes a plain sheet, a card board, and a thin sheet. It is assumed that the card board have a thickness twice that of the plain sheet and the thin sheet have a thickness half that of the plain sheet. Thereby, if the accumulating tray 42 can stack 200 plain sheets, it can stack 100 card boards or 400 thin sheets. When with reference to the information designating the type of the sheet S in the printing condition information included in the printing job, the CPU 205 determines the process in accordance with this information, the processing corresponding to the type of the sheet can be accomplished.

Specifically, when the type of the sheet S is the card board, if the number of the sheets ranges from 1 to 50, the printing is restarted without using the sheet bundles S1 stacked on the accumulating tray 42. On the other hand, when a printing interrupting factor is generated, if the number of the counted sheets ranges from 51 to 100, the CPU 205 restarts the printing using the sheet bundles S1 stacked on the accumulating tray 42.

Specifically, when the type of the sheet S is the thin sheet, if the number of the sheets ranges from 1 to 200, the printing is restarted without using the sheet bundles S1 stacked on the accumulating tray 42. On the other hand, when a printing interrupting factor is generated, if the number of the counted sheets ranges from 201 to 400, the CPU 205 restarts the printing using the sheet bundles S1 stacked on the accumulating tray 42.

In the description above, the accumulating tray 42 can stack 200 sheets thereon, and the decision between the use of the sheet bundles S1 stacked on the accumulating tray for restarting the printing and no use thereof is switched at 100-sheets as a break point, for example. However, another form may also be made. Specifically, the break point number may be arbitrarily set by an operator via the operation unit 204. In this case, the break point may include an arbitrary number such as 20 sheets and 80 sheets. The break point number may also be independently set in accordance with the type of the sheet S.

As described above, according to the third embodiment, when an interrupting factor for interrupting the printing job is generated, the selection between the use of the sheet bundles S stacked on the accumulating tray and no use thereof is made for restarting the printing in accordance with the number of the sheets accumulated on the accumulating tray 42. Thereby, the selection between the economy due to use of the sheets already stacked on the accumulating tray 42 and the removal of defective bound books due to no use of these sheets can be appropriately made. That is, when the number of the sheets is small, even the sheet bundle S1 is not used, the economy is not affected so much, so that the printing is restarted without using the sheet bundle S1. On the other hand, when the number of the sheets is large, if the sheet bundle S1 is not used, the economy is affected therefrom, so that the printing is restarted using the sheet bundle S1.

Other Embodiments

According to the first to third embodiments described above, in the bookbinding system 2000, the sheet S conveyed from the printing apparatus 105 is automatically conveyed to the casing-in bookbinding apparatus 103 without operation by an operator. Alternatively, the sheet S may be once discharged onto a discharge tray (not shown) included in the printing apparatus 105 so as to form a sheet bundle S, and the sheet bundle S may be conveyed onto the accumulating tray 42 by the operator. In this case, after the operator accumulates the sheet bundle S1 onto the accumulating tray 42, the casing-in bookbinding apparatus 103 executes the casing-in bookbinding using the cover sheet S2 stacked on the cover sheet stack tray 70.

According to the first to third embodiments, the bookbinding system 2000 includes the casing-in bookbinding apparatus 103 executing the casing-in bookbinding; alternatively, it may have another bookbinding apparatus. For example, it may be a stapling apparatus which executes stapling after the cover sheet S2 is wrapped around the sheet bundle S1 without applying an adhesive, instead of bonding a book cover on the backbone region 1002 of the cover sheet S2 with a laid-out back cover. In this case, the sheet bundle S1 is aligned with the cover sheet S2 with stapling wires. It may also be an apparatus, in which a cover sheet with a laid-out book cover is fed from the cover sheet stack tray 70, so that the sheet bundle S1 is bound with the cover sheet S2 with a binder tape. In this case, the sheet bundle S1 is aligned with the cover sheet S2 with the binder tape.

An end of the present invention is also achieved by feeding a storage medium having a program cord, recorded therein, of the software accomplishing functions of the embodiments described above to a system or an apparatus. In this case, a computer of the system or the apparatus reads out and executes the program cord stored in the storage medium so as to achieve the functions of the embodiments. In this case, the program cord itself read out of the storage medium achieves the functions of the embodiments, so that the storage medium having the program cord stored therein constitutes the present invention.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2006-020970 filed Jan. 30, 2006, which is hereby incorporated by reference herein in its entirety.

What is claimed is:

1. A bookbinding apparatus comprising:

an inputting unit configured to input a printing job including image data for a plurality of pages;

a printing unit configured to print images on a plurality of sheets based on the printing job inputted by the inputting unit;

an accumulating unit configured to accumulate the plurality of the sheets printed by the printing unit as a sheet bundle;

a bookbinding unit configured to form a bound book using the sheet bundle accumulated by the accumulating unit;

a counting unit configured to count the number of the sheets accumulated by the accumulating unit;

a control unit, when an interrupting factor for interrupting the printing is generated, configured to restart the printing, if the number of sheets counted by the counting unit is a first number or less, from the top page of the printing job as well as for resuming the printing from the page associated with the interrupting factor, if the number of sheets counted by the counting unit is a second number or more; and a selecting unit, when the interrupting factor is generated and if the number of sheets counted by the counting unit is larger than the first number as well as smaller than the second number, configured to select a priority, upon restarting the printing, between the use of the sheet bundle accumulated by the accumulating unit for forming a bound book and no use of the sheet bundle, wherein when the interrupting factor is generated, the control unit resumes the printing from the page associated with the interrupting factor, if the number of sheets counted by the counting unit is larger than the first number as well as smaller than the second number and when the selecting unit selects the use of the sheet bundle, and when the selecting unit selects no use of the sheet bundle, the control unit allows the printing unit to restart the printing from the top page of the printing job.

2. The apparatus according to claim 1, wherein the printing job includes processing condition information designating processing conditions executed by the printing unit, and wherein the selecting unit selects the priority between use of the sheet bundle for forming a bound book and no use of the sheet bundle based on the processing condition information.

3. The apparatus according to claim 1, further comprising a receiving unit, configured to receive an input of information from an operator of the bookbinding apparatus, which upon restarting the printing, designates whether the sheet bundle stacked by the accumulating unit is used for forming a bound book or the sheet bundle is not used, wherein the selecting unit selects the priority between use of the sheet bundle and no use of the sheet bundle for forming a bound book based on the information inputted by the operator.

4. The apparatus according to claim 1, wherein the selecting unit selects the priority between use of the sheet bundle and no use of the sheet bundle for forming a bound book in accordance with the interrupting factor.

5. The apparatus according to claim 4, wherein the printing unit executes the printing by forming developer images corresponding to the image data on a sheet, and the printing unit includes a holding unit configured to hold the developer, and wherein the selecting unit selects the no use of the sheet bundle when the interrupting factor is a shortage of the developer held by the holding unit.

6. The apparatus according to claim 4, further comprising a detecting unit configured to detect a generation of a sheet conveying defect on a conveying path of the printing unit, wherein the selecting unit selects the no use of the sheet bundle when the interrupting factor is the generation of the sheet conveying defect.

7. The apparatus according to claim 4, further comprising a sheet stacking unit configured to stack the sheets, wherein the selecting unit selects the use of the sheet bundle when the interrupting factor is a shortage of the sheets stacked by the sheet stacking unit.

8. The apparatus according to claim 4, further comprising a feeding unit configured to feed a cover sheet with a laid-out book cover, wherein the bookbinding unit forms the bound book by bonding one end of the sheet bundle to a portion of the cover sheet to be a spine of the bound book.

9. The apparatus according to claim 1, wherein the first number of sheets is differentiated from the second number of sheets in accordance with a type of the sheet.

10. A method comprising:

receiving a printing job including image data for a plurality of pages;

printing images on a plurality of sheets based on the received printing job so as to accumulate the sheets on an accumulating unit for forming a bound book using a sheet bundle accumulated on the accumulating unit;

counting the number of the sheets accumulated on the accumulating unit;

interrupting the printing when an interrupting factor for interrupting the printing is generated during the printing;

when the interrupting factor is generated, restarting the printing, if the counted number of sheets accumulated on the accumulation unit is a first number or less, from a top page of the printing from the page associated with the interruption factor job while resuming the printing, if the counted number of sheets accumulated on the accumulation unit is a second number or more; and when the interrupting factor is generated and if the counted number of sheets accumulated on the accumulation unit is larger than the first number as well as smaller than the second number, selecting a priority, upon restarting the interrupted printing, between the use of the sheet bundle accumulated on the accumulating unit for forming a bound book and no use of the sheet bundle, wherein, when the interrupting factor is generated, the interrupted printing is resuming from the page associated with the interruption factor, if the counted number of sheets accumulated on the accumulation unit is larger than the first number as well as smaller than the second number and when the use of the sheet bundle is selected.

11. The method according to claim 10, wherein, when the interrupting factor is generated, the interrupted printing is restarted from the top page of the printing job if no use of the sheet bundle is selected.

* * * * *